US009177504B2

(12) United States Patent
Kasai et al.

(10) Patent No.: US 9,177,504 B2
(45) Date of Patent: Nov. 3, 2015

(54) IMAGE DISPLAY DEVICE

(75) Inventors: Naruhiko Kasai, Yokohama (JP); Masato Ishii, Tokyo (JP); Tohru Kohno, Kokubunji (JP); Hajime Akimoto, Kokubunji (JP)

(73) Assignees: JAPAN DISPLAY INC., Tokyo (JP); PANASONIC LIQUID CRYSTAL DISPLAY CO., LTD., Hyogo-Ken (JP)

( * ) Notice: Subject to any disclaimer, the term of this patent is extended or adjusted under 35 U.S.C. 154(b) by 1054 days.

(21) Appl. No.: 12/353,281

(22) Filed: Jan. 14, 2009

(65) Prior Publication Data

US 2009/0244043 A1 Oct. 1, 2009

(30) Foreign Application Priority Data

Mar. 27, 2008 (JP) ..... 2008-082398

(51) Int. Cl.
*G09G 3/32* (2006.01)
*G09G 3/34* (2006.01)

(52) U.S. Cl.
CPC ..... *G09G 3/3233* (2013.01); *G09G 3/3426* (2013.01); *G09G 2300/0842* (2013.01); *G09G 2310/0275* (2013.01); *G09G 2320/029* (2013.01); *G09G 2320/0233* (2013.01); *G09G 2320/0285* (2013.01); *G09G 2320/041* (2013.01); *G09G 2320/043* (2013.01); *G09G 2330/028* (2013.01)

(58) Field of Classification Search
CPC ..... G09G 3/34; G09G 3/342; G09G 3/3426
USPC ..... 345/211–213, 204, 52, 77, 101
See application file for complete search history.

(56) References Cited

U.S. PATENT DOCUMENTS

| | | | | |
|---|---|---|---|---|
| 5,625,373 | A * | 4/1997 | Johnson | 345/58 |
| 6,285,349 | B1 * | 9/2001 | Smith | 345/690 |
| 6,963,299 | B2 | 11/2005 | Inoue | |
| 7,355,574 | B1 * | 4/2008 | Leon et al. | 345/82 |
| 7,423,617 | B2 | 9/2008 | Giraldo et al. | |
| 7,626,565 | B2 * | 12/2009 | Tsuge | 345/76 |
| 8,363,001 | B2 * | 1/2013 | Tanizoe et al. | 345/102 |

(Continued)

FOREIGN PATENT DOCUMENTS

| | | |
|---|---|---|
| JP | 2002-229513 | 8/2002 |
| JP | 2004-038209 | 2/2004 |

(Continued)

*Primary Examiner* — William Boddie
*Assistant Examiner* — Jeffrey A Parker
(74) *Attorney, Agent, or Firm* — Lowe Hauptman & Ham, LLP

(57) ABSTRACT

To provide an image display device having a circuit for solving burning phenomenon without increasing the size of the circuit. An image display device is provided having a display unit formed using display devices, a signal line for inputting a display signal voltage to the display unit, and a display control unit for controlling the display signal voltage, the image display device comprising a detection power source, a switch for causing a current of the detection power source to flow to the display device, a detection circuit for detecting the current, and a detection information storage circuit for storing information, and compensating the display signal voltage, using the information, wherein using a first reference voltage, and current detection is carried out, the detection circuit feeds back the current detected to set a second reference voltage different from the first reference voltage, and carries out current detection.

14 Claims, 15 Drawing Sheets

(56) References Cited

U.S. PATENT DOCUMENTS

| | | | | |
|---|---|---|---|---|
| 2002/0180721 | A1 | 12/2002 | Kimura et al. | |
| 2003/0063081 | A1* | 4/2003 | Kimura et al. | 345/211 |
| 2003/0122743 | A1* | 7/2003 | Suzuki | 345/63 |
| 2005/0052302 | A1* | 3/2005 | Inoue | 341/144 |
| 2007/0252829 | A1* | 11/2007 | Kobashi | 345/204 |
| 2008/0030438 | A1 | 2/2008 | Marx et al. | |
| 2008/0055210 | A1* | 3/2008 | Cok | 345/77 |

FOREIGN PATENT DOCUMENTS

| | | |
|---|---|---|
| JP | 2005-86616 | 3/2005 |
| JP | 2006-505816 | 2/2006 |
| JP | 2007-017479 | 1/2007 |
| JP | 2007-536585 | 12/2007 |

* cited by examiner

IMAGE DISPLAY DEVICE

CROSS-REFERENCE TO RELATED APPLICATION

The present application claims priority from Japanese application JP 2008-082398 filed on Mar. 27, 2008, the content of which is hereby incorporated by reference into this application.

BACKGROUND OF THE INVENTION

1. Field of the Invention

The present invention relates to an image display device. More particularly, the present invention relates to an image display device which has a display area comprising, e.g., an EL (Electro Luminescence) device, an organic EL device, or another type of light emitting display device (a pixel).

2. Description of the Related Art

An image display device of this type has characteristic that the light emission brightness of a display device (a light emitting device) thereof is proportional to the amount of current flowing through the device. Therefore, by controlling the amount of current flowing through the device, it is possible to make gradation display.

However, e.g., an organic EL device has characteristic that brightness difference will be caused between a pixel which keeps lighting and an otherwise pixel due to deterioration of the device characteristic. Such brightness difference among the display devices is perceived by human eyes as "burning phenomenon", contributing to shortening of the lifetime of the image display device.

In view of the above, e.g., JP 2004-38209 A discloses a technique for solving the above described "burning phenomenon", utilizing a means for measuring the amount of current flowing through respective display devices and compensating for the deterioration, based on the measured current amount.

SUMMARY OF THE INVENTION

It should be noted that, in order to measure the amount of current flowing through the respective display devices, the image display device disclosed in JP 2004-38209 A has a current measuring device comprising, e.g., an A/D conversion unit. The current measuring device is required to have a significantly wide measurement range in order to sufficiently cope with large current change due to deterioration of a display device and also current change due to temperature and manufacturing variation. It causes that the circuit size of the current measuring device inevitably increases. Some technique is required to avoid the increase. However, it is not mentioned in JP 2004-38209 A.

In view of the above, the present invention has an object to provide an image display device having a circuit for solving burning phenomenon without increasing the circuit size.

An image display device according to the present invention has a detection means (a current measuring device) for measuring the amount of current flowing through a display device. At first, the detection means has a reference voltage appropriate to detection for relatively large change of current due to temperature. A result of the detection provides a new reference voltage to enable the detection means to detect smaller change of current due to deterioration of the display device. Next, the detection means detect the small current change due to the deterioration with the new reference voltage. With the above, it is possible to detect relatively large change of current due to temperature, as well as smaller change of current due to device deterioration, using the same detection means.

The following structures, for example, may be used as a structure according to the present invention.

(1) An image display device according to the present invention is an image display device having a display unit formed using a plurality of display devices, a signal line for inputting a display signal voltage to the display unit, and a display control unit for controlling the display signal voltage, the image display device comprising a detection power source; a switch for causing a current from the detection power source to flow to the display device; a detection circuit for detecting the current flowing to the display device; and a detection information storage circuit for storing information detected by the detection circuit, and compensating the display signal voltage, using the information, wherein after a first current measurement range is set, using a first reference voltage, and current detection is carried out, the detection circuit feeds back the current detected to set a second current measurement range, using a second reference voltage different from the first reference voltage, and carries out current detection.

(2) According to an image display device according to the present invention, on the premise of the structure according to (1), the switch may connect the detection power source and the display device during a period within one display period, the period being different from a period during which the display signal voltage is output.

(3) According to an image display device according to the present invention, on the premise of the structure according to (1), the detection power source may be a constant current source.

(4) According to an image display device according to the present invention, on the premise of the structure according to (1), the detection circuit may determine a level of a deteriorated device, and the detection information storage circuit may store a state of the deteriorated devices for one screen image.

(5) According to an image display device according to the present invention, on the premise of the structure according to (1), the display control circuit may correct display data to be input to the deteriorated device.

(6) According to an image display device according to the present invention, on the premise of the structure according to (1), there may be provided a switch for supplying, in a time sharing manner, respective signals for red, green, and blue to the display unit when inputting the display signal voltage.

(7) According to an image display device according to the present invention, on the premise of the structure according to (1), a width of the first current measurement range may be identical to a width of the second current measurement range.

(8) According to an image display device according to the present invention, on the premise of the structure according to (1), a width of the first current measurement range may be different from a width of the second current measurement range.

(9) An image display device according to the present invention is an image display device having a display unit formed using a plurality of display devices, a data signal line for inputting a display signal voltage to the display unit, and a display control unit for controlling the display signal voltage, the image display device comprising a detection power source, a switch for causing a current of the detection power source to flow via a detection signal line to the display device, a detection circuit for detecting an amount of the current flowing to the display device, and a detection information storage circuit for storing information detected by the detection circuit, and compensating the display signal voltage, using the information, wherein the data signal line and the detection signal line are formed using a common signal line to be switched by a switching circuit, and after a first current measurement range is set, using a first reference voltage, and current detection is carried out, the detection circuit feeds back the amount of current detected to set a second current measurement range, using a second reference voltage different from the first reference voltage, and carries out current detection.

(10) According to an image display device according to the present invention, on the premise of the structure according to (9), the switch may connect the detection power source and the display device during a period within one display period, the period being different from a period during which the display signal voltage is output.

(11) According to an image display device according to the present invention, on the premise of the structure according to (9), the detection power source may be a constant current source.

(12) According to an image display device according to the present invention, on the premise of the structure according to (9), the detection circuit may determine a level of a deteriorated device, and the detection information storage circuit may store a state of the deteriorated devices for one screen image.

(13) According to an image display device according to the present invention, on the premise of the structure according to (9), the display control circuit may correct display data to be input to the deteriorated device.

(14) According to an image display device according to the present invention, on the premise of the structure according to (9), there may be provided a switch for supplying, in a time sharing manner, respective signals for red, green, and blue to inside the display unit when inputting the display signal voltage.

(15) According to an image display device according to the present invention, on the premise of the structure according to (9), a width of the first current measurement range may be identical to a width of the second current measurement range.

(16) According to an image display device according to the present invention, on the premise of the structure according to (9), a width of the first current measurement range may be different from a width of the second current measurement range.

Note that the present invention is not limited to the above described structure, and can be modified in many ways within a range not departing from the technical concept of the present invention. Also, an example of a structure of the present invention other than those described above will become obvious from the entire description of this specification and accompanying drawings.

The image display device according to the present invention has a circuit for solving burning phenomenon without increasing the circuit size.

Other advantages of the present invention will become obvious from the entire description of the specification.

BRIEF DESCRIPTION OF THE DRAWINGS

These and other features, objects and advantages of the present invention will become more apparent from the following description when taken in conjunction with the accompanying drawings wherein.

DESCRIPTION OF THE EMBODIMENTS

Figure 1:
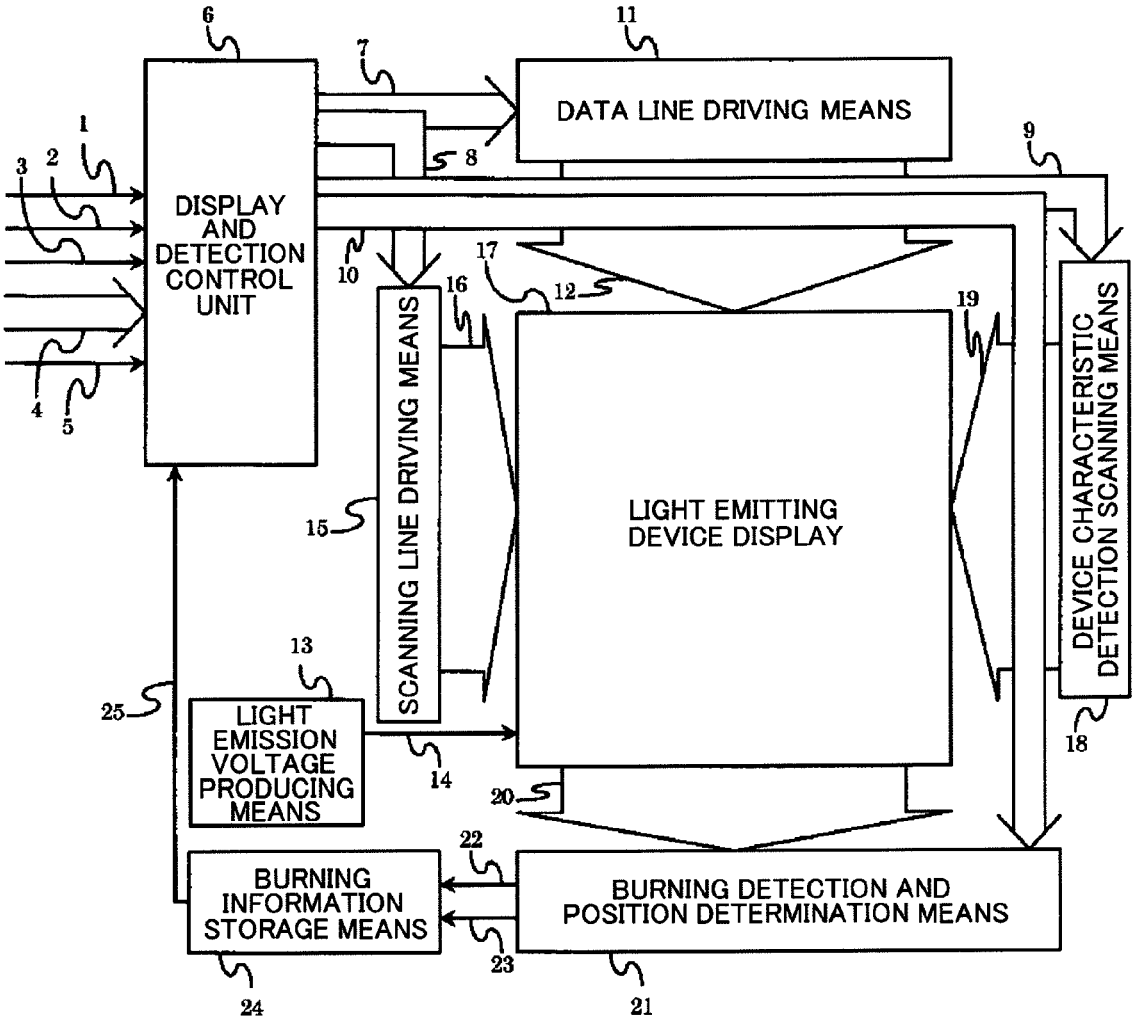
FIG. 1 is a diagram showing one embodiment of an image display device according to the present invention, particularly showing a light emitting device display.

Embodiments of the present invention will be described, with reference to the accompanying drawings. Note that an identical or similar structural member is given an identical reference numeral in the respective diagrams and embodiments, with description thereof not repeated.

Here, the respective reference numerals refer to respective members as described below: 6 . . . a display and detection control unit, 11 . . . a data line driving means, 13 . . . a light emission voltage producing means, 15 . . . a scanning line driving means, 17 . . . a light emitting device display, 18 . . . a device characteristic detection scanning means, 21 . . . a burning detection and position determination means, 24 . . . a burning information storage means, 26 . . . a burnt pixel data correction means, 28 . . . a driving timing producing means, 37 . . . a burning compensation amount calculating means, 44 . . . a first R selection switch, 45 . . . a first G selection switch, 46 . . . a first B selection switch, 47 . . . a second R selection switch, 62 . . . a data writing switch, 63 . . . a writing capacitance, 64 . . . a driving transistor, 65 . . . an organic EL, 73 . . . a detection power source, 74 . . . a first detection line switch, 75 . . . a second detection line switch, 76 . . . a third detection line switch, 77 . . . a fourth detection line switch, 79 . . . a shift register, 84 . . . an A/D conversion means, 85 . . . a burnt pixel position information producing means, 94 . . . an organic EL current/voltage characteristic, 97 . . . a deteriorated organic EL device current/voltage characteristic, 101 . . . a high temperature organic EL device current/voltage characteristic, 103 . . . a high temperature deteriorated organic EL device current/voltage characteristic, 108 . . . a first comparator, 109 . . . a second comparator, 110 . . . third comparator, 111 . . . a fourth comparator, 112 . . . a fifth comparator, 113 . . . a sixth comparator, 114 . . . a seventh comparator, 137 . . . a seven-to-three decoder, 141 . . . a reference voltage control means, 143 . . . an upper reference voltage producing means, 145 . . . a lower reference voltage producing means, 147 . . . a detection timing control means, 151 . . . an upper reference voltage switching means, 152 . . . a lower reference voltage switching means, 156 . . . a display/detection switching control unit, 158 . . . a data line driving and burning position determining means, 160 . . . a data line and detection line sharing light emitting device display, 161 . . . a one horizontal latch and analog conversion means, 167 . . . a first data line detection switch, 168 . . . a second data line detection switch, 169 . . . a third data line detection switch, 170 . . . a fourth data line detection switch, and 175 . . . an RGB switching control means.

First Embodiment

In the following, a first embodiment of the present invention will be described in detail, referring to the accompanying drawings.

FIG. 1 shows an image display device according to one embodiment of the present invention, specifically showing an example of a light emitting device display device.

In FIG. 1, reference numeral 1 refers to a vertical synchronous signal, 2 refers to a horizontal synchronous signal, 3 refers to a data enable, 4 refers to display data, and 5 refers to a synchronous clock. A vertical synchronous signal 1 is a signal for one display period (one frame cycle). A horizontal synchronous signal 2 is a signal for one horizontal period. A data enable signal 3 is a signal indicating a period (a display effective period) with display data 4 effective. All of these signals are input in synchronism with a synchronous clock 5. In this embodiment, the display data for one screen image is sequentially transferred in a raster scanning manner, beginning with one for the pixel at the upper left end of the screen image. Information for one pixel comprises, e.g., six-bit digital data.

Reference numeral 6 refers to a display and detection control unit, 7 refers to a data line control signal, 8 refers to a scanning line control signal, 9 refers to a detection scanning line control signal, and 10 refers to a detection line control signal. Using the vertical synchronous signal 1, the horizontal synchronous signal 2, the data enable signal 3, the display data 4, and the synchronous clock 5, the display and detection control unit 6 produces a data line control signal 7 and a scanning line control signal 8 for display control, and a detection scanning line control signal 9 and a detection line control signal 10 for detection of characteristic of a display device, to be described later.

Reference numeral 11 refers to a data line driving means, and 12 refers to a data line driving signal. The data line driving means 11 produces a signal voltage to be written into a pixel comprising a light emitting device (to be described later) and a triangular wave signal (to be described later) according to the data line control signal 7, and outputs as a data line driving signal 12.

Reference numeral 13 refers to a light emission voltage producing means, and 14 refers to a light emission voltage. The light emission voltage producing means 13 produces a power source voltage to supply a current for light emission from a light emitting device (to be described later), and outputs as the light emission voltage 14.

Reference numeral 15 refers to a scanning line driving means, 16 refers to a scanning line selection signal, and 17 refers to a light emitting device display. The light emitting device display 17 refers to a display which employs a light emitting diode, an organic EL, or the like as a display device. The light emitting device display 17 has a plurality of light emitting devices (pixel units) arranged in a matrix. A display operation relative to the light emitting device display 17 is carried out as follows. That is, a pixel into which data is to be written is selected in response to a scanning line driving signal 16 output from the scanning line driving means 15, and a signal voltage of the data line driving signal 12 output from the data line driving means 11 is written into the selected pixel according to the triangular wave signal. Voltage to drive the light emitting device is supplied as the light emission voltage 14.

Note that the data line driving means 11 and the scanning line driving means 15 may be formed, using an LSI for each or a single LSI for both, and may be formed on a glass substrate where the pixel units are formed. The light emitting device display 17 has resolution of, e.g., 240×320 dots, each dot comprising three pixels for R (red), G (green), and B (blue) arranged from left to right. That is, the display 17 has 720 pixels in the horizontal direction, and can adjust the brightness of light emitted from the light emitting device by adjusting the amount of current flowing to the light emitting device and a period of time with the light emitting device lighting. The larger the amount of current flowing to the light emitting device is, the brighter the light emitting device is, and the longer the period with the light emitting device lighting is, the brighter the light emitting device is.

Reference numeral 18 refers to a device characteristic detection scanning means, and 19 refers to a detection scanning line selection signal. The device characteristic detection operation means 18 produces a detection scanning line selection signal 19 for selecting a scanning line for detection of the state of deterioration of a light emitting device in the light emitting device display 17.

Reference numeral 20 refers to a detection line output signal, 21 refers to a burning detection and position determination means, 22 refers to a burning detection result, and 23 refers to position information. Depending on the result of detection of the state of deterioration of a light emitting device in a single horizontal line selected in response to the detection scanning line selection signal 19 in the light emitting device display 17, the detection line output signal 20 outputs the burning detection result 22 and the corresponding position information 23 about a position in the light emitting device display 17 via the burning detection and position determination means 21.

Reference numeral 24 refers to a burning information storage means, and 25 refers to burning correction pixel information. The burning information storage means 24 once stores the burning detection result 22 according to the position information 23, and outputs as the burning correction pixel information 25. Note that the burning detection result 22 indicates the level of deterioration, and the position information 23 is address information indicating the position in the light emitting device display 17. The burning information storage means 24 stores the burning detection result 22 at an address according to the position information 23, and outputs the burning detection result 22 corresponding to the position information 23 to the burning correction pixel information 25 at a display time corresponding to the position information 23.

Figure 2:
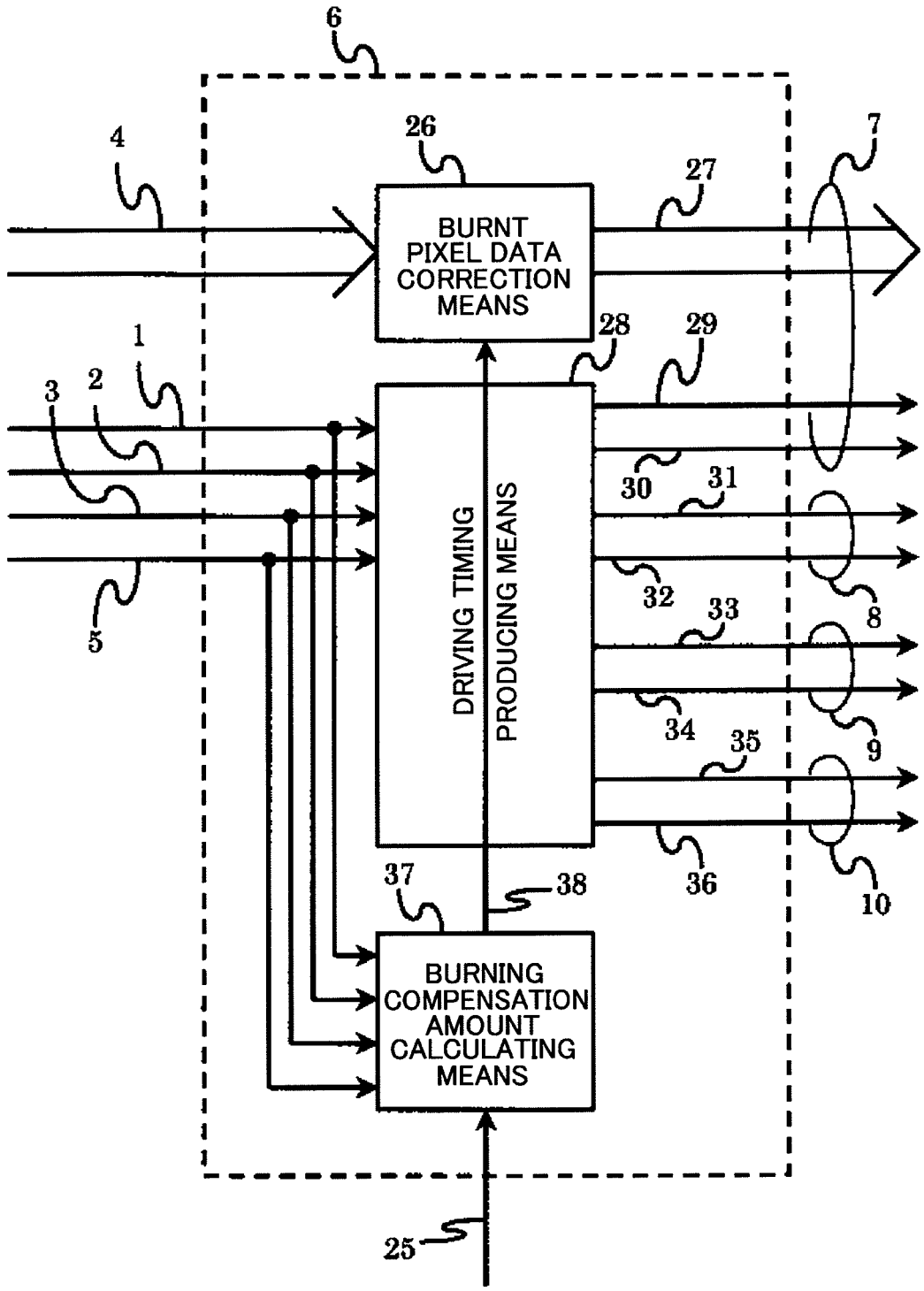
FIG. 2 is a diagram showing one embodiment of an interior structure of a display and detection control unit shown in FIG. 1.

FIG. 2 is a diagram showing one embodiment of an internal structure of the above described display and detection control unit 6. In FIG. 2, reference numeral 26 refers to a burnt pixel data correction means, and 27 refers to corrected display data. The burnt pixel data correction means 26 corrects the display data 4, based on a burning compensation amount, to be described later, and outputs as corrected display data 27.

Reference numeral 28 refers to a driving timing producing means, 29 refers to a horizontal start signal, 30 refers to a horizontal shift clock, 31 refers to a vertical start signal, and 32 refers to a vertical shift clock. The driving timing producing means 28 produces a horizontal start signal 29 indicating the beginning of a horizontal display position, a horizontal shift clock 30 for indicating a time to latch the display data 4 by every single pixel, a vertical start signal 31 indicating the beginning of a vertical display position, and a vertical shift clock 32 for sequentially shifting a scanning line to select.

Reference numeral 33 refers to a vertical detection start signal, 34 refers to a vertical detection shift clock, 35 refers to a horizontal detection start signal, and 36 refers to a horizontal detection shift clock. The driving timing producing means 28 produces a vertical detection start signal 33 indicating the beginning of a vertical detection position, a vertical detection shift clock 34 for sequentially shifting a detection scanning line, A horizontal detection start signal 35 indicating the beginning of a horizontal detection position, and a horizontal detection shift clock 36 for sequentially shifting a horizontal detection position.

Reference numeral 37 refers to a burning compensation amount calculating means, and 38 refers to a burning compensation amount. The burning compensation amount calculating means 37 determines the level of burning, based on the burning correction pixel information 25, then calculates a compensation amount, and outputs as a burning compensation amount 38.

Figure 3:
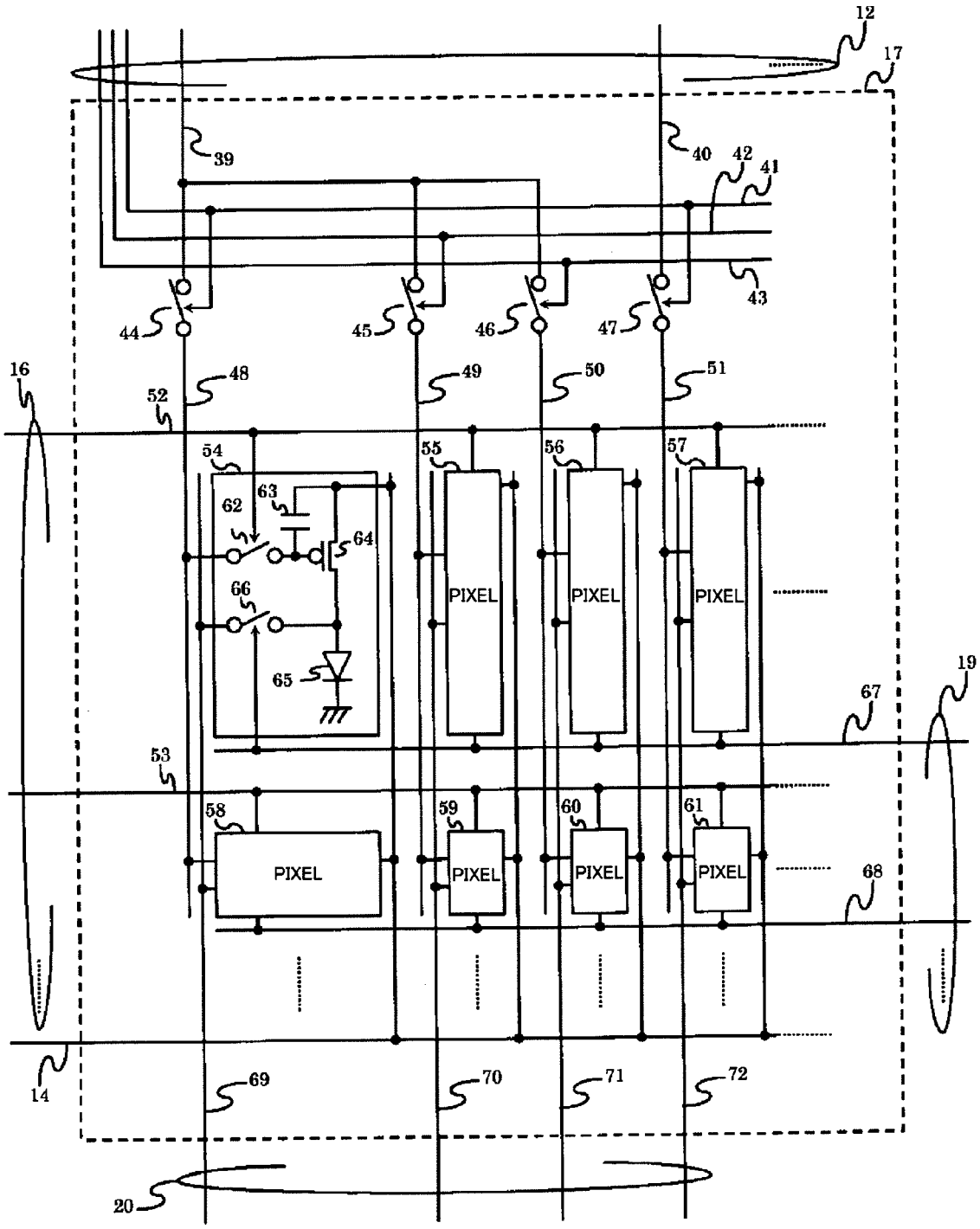
FIG. 3 is a diagram showing one embodiment of an interior structure of the light emitting device display shown in FIG. 1.

FIG. 3 is a diagram showing one embodiment of an internal structure of the above described light emitting device display 17, specifically showing an example in which an organic EL device is used as a light emitting device. In FIG. 3, reference numeral 39 refers to a first data line output, 40 refers to a second data line output, 41 refers to an R selection signal, 42 refers to a G selection signal, 43 refers to a B selection signal, 44 refers to a first R selection switch, 45 refers to a first G selection switch, 46 refers to a first B selection switch, and 47 refers to a second R selection switch. The first data line output 39 is connected to the first R selection switch 44, the first G selection switch 45, and the first B selection switch 46. Likewise, the second, third, and up to $240^{th}$ data line outputs are each connected to the R, G, and B selection switches. The first R selection switch 44, the first G selection switch 45, and the first B selection switch 46 are turned on in response to an R selection signal 41, a G selection signal 42, and a B selection signal 43, respectively. The R selection signal 41, the G selection signal 42, and the B selection signal 43 are sequentially turned on and remain in the ON state for one third of one horizontal period, respectively. Use of the selection signals makes it possible to output signal voltages from one single data line output to the three R, G, and B data lines, respectively.

Reference numeral 48 refers to a first R data line, 49 refers to a first G data line, 50 refers to a first B data line, 51 refers to a second R data line, 52 refers to a first scanning line, 53 refers to a second scanning line, 54 refers to a first row first column R pixel, 55 refers to a first row first column G pixel, 56 refers to a first row first column B pixel, 57 refers to a first row second column R pixel, 58 refers to a second row first column R pixel, 59 refers to a second row first column G pixel, 60 refers to a second row first column B pixel, and 61 refers to a second row second column R pixel. The first R data line 48, the first G data line 49, the first B data line 50, and the second R data line 51 are data lines each for outputting a signal voltage to a pixel. The first scanning line 52 and the second scanning line 53 are signal lines for outputting a first scanning line selection signal and a second scanning line selection signal (to be described later), respectively, to respective pixels. A signal voltage is written via the data line into a pixel concerning a scanning line selected in response to a scanning line selection signal, so that the brightness of the pixel is controlled according to the signal voltage. In the above, the light emission voltage 14 is used as a light emission power source. It should be noted that although the internal pixel structure is shown only in the first row first column R pixel 54 here, the first row first column G pixel 55, the first row first column B pixel 56, the first row second column R pixel 57, the second row first column R pixel 58, the second row first column G pixel 59, the second row first column B pixel 60, and the second row second column R pixel 61 also have similar structures.

Reference numeral 62 refers to a data writing switch, 63 refers to a writing capacitance, 64 refers to a driving transistor, and 65 refers to an organic EL device. The data writing switch 62 is turned on in response to a signal from the first scanning line 52, upon which a signal voltage from the first R data line 48 is accumulated in the writing capacitance 63, and the driving transistor 64 supplies a driving current to the organic EL device 65 in accordance with the accumulated signal voltage in the writing capacitance 63. That is, the light emission brightness of the organic EL device 65 is determined, based on the signal voltage written into the writing capacitance 63 and the light emission voltage 14.

As described above, it is assumed that such a number of pixels that achieves 240×320 resolution are provided to the light emitting device display 17, and that 320 horizontal scanning lines, namely $1^{st}$ to $320^{th}$ line, are arranged vertically, and 720 vertical data lines, including 240 lines, namely $1^{st}$ to $240^{th}$ dot, for each of R, G, and B, are arranged horizontally.

Reference numeral 66 refers to a detection switch, 67 refers to a first detection scanning line, 68 refers to a second detection scanning line, 69 refers to a first detection line, 70 refers to a second detection line, 71 refers to a third detection line, and 72 refers to a fourth detection line. The detection switch 66 is turned in response to a signal from the first detection scanning line 67, and during a period with the detection switch 66 in the ON state, the characteristic of the organic EL device 65 is output to the first detection line 69. Likewise, the second detection scanning line 68, second detection line 70, third detection line 71, and fourth detection line 72 are connected to the respective organic EL devices via detection switches in the respective pixels. Here again, e.g., 720 detection lines are provided.

Figure 4:
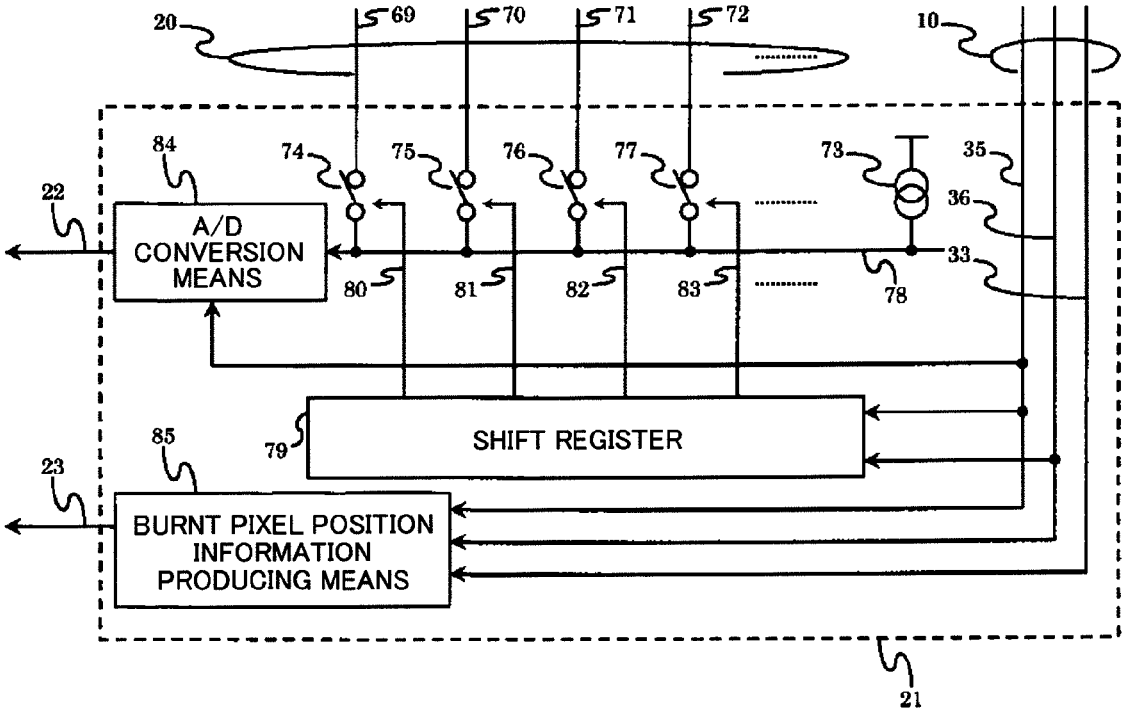
FIG. 4 is a diagram showing one embodiment of an interior structure of a burning detection and position determination means shown in FIG. 1.

FIG. 4 is a diagram showing one embodiment of an internal structure of the burning detection and position determination means 21. In FIG. 4, reference numeral 73 refers to a detection power source, 74 refers to a first detection line switch, 75 refers to a second detection line switch, 76 refers to a third detection line switch, 77 refers to a fourth detection line switch, and 78 refers to a detection output line. The first detection line switch 74, the second detection line switch 75, the third detection line switch 76, and the fourth detection line switch 77, and up to the $720^{th}$ detection line switch are sequentially and horizontally selected to be turned on in response to a shift register, to be described later. During a period with the first detection line switch 74 in the ON state, a signal from the first detection line 69 (characteristic of the organic EL device connected to the first detection line 69) is output to the detection output line 78 by the detection power source 73, a constant current source. Likewise, during the respective periods with the second detection line 70, third detection line 71, fourth detection line 72, and up to the $720^{th}$ detection line in the ON state, signals from the second detection line 70, the third detection line 71, the fourth detection line 42, and up to the $720^{th}$ detection line are respectively output to the detection output line 78.

Reference numeral 79 refers to a shift register, 80 refers to a first detection line selection signal, 81 refers to a second detection line selection signal, 82 refers to a third detection line selection signal, and 83 refers to a fourth detection line selection signal. In response to the horizontal detection start signal 35 and the horizontal detection shift clock 36, the first detection line selection signal 80, the second detection line selection signal 81, the third detection line selection signal 82, and the fourth detection line selection signal 83 are output to sequentially switch the detection line switches as described above.

Reference numeral 84 refers to an A/D conversion means. The characteristic of the organic EL device, expressed in an analog value, output from the detection output line 78 is subjected to digital conversion and output as the burning detection result 22.

Reference numeral 85 refers to a burnt pixel position information producing means for determining the position of a pixel, based on the horizontal detection start signal 35 and the horizontal detection shift clock 36, and outputting as the position information 23.

Figure 5A:
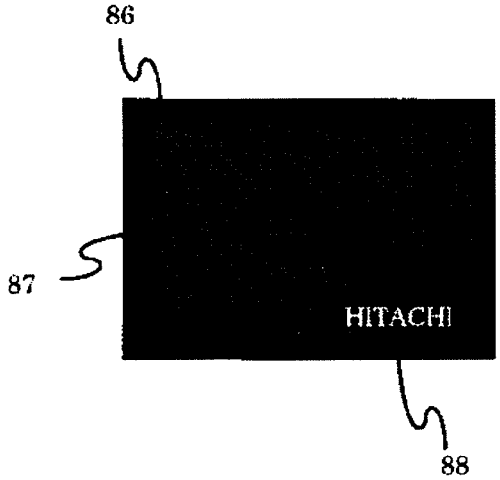
FIG. 5A and FIG. 5B are diagrams explaining an example of display presentation with burning occurring in the light emitting display shown in FIG. 1.
Figure 5B:
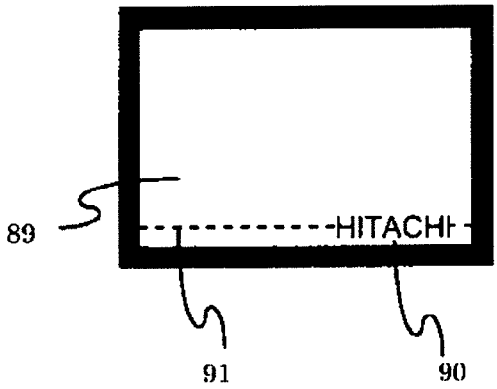

FIGS. 5A and 5B are diagrams showing an example of a displayed screen image with burning occurring in the light emitting display 17. In FIG. 5A, the majority of the display area is shown black. Reference numeral 86 refers to a display outer frame, 87 refers to black representation, and 88 refers to a fixed display pattern. FIG. 5A shows a state in which a fixed display pattern 88 is kept displayed for a long time in the same position with the black representation 87 shown as the background of the effective display area within the display outer frame 86.

FIG. 5B shows a deterioration state when the whole area of the display area is shown white. Reference numeral 89 refers to white representation, 90 refers to a burnt pattern, and 91 refers to a single horizontal line. When the fixed pattern 88 is displayed for a long time, deterioration will progress, compared to the nearby black representation 87 portion. Therefore, with the white presentation 89 shown, a burnt pattern 90 is observed with the pixels having shown the fixed pattern 88 and thus subjected to progressed deterioration. Accordingly, a pixel with burning and one without burning are aligned in the single horizontal line 91 in the display area.

Figure 6:
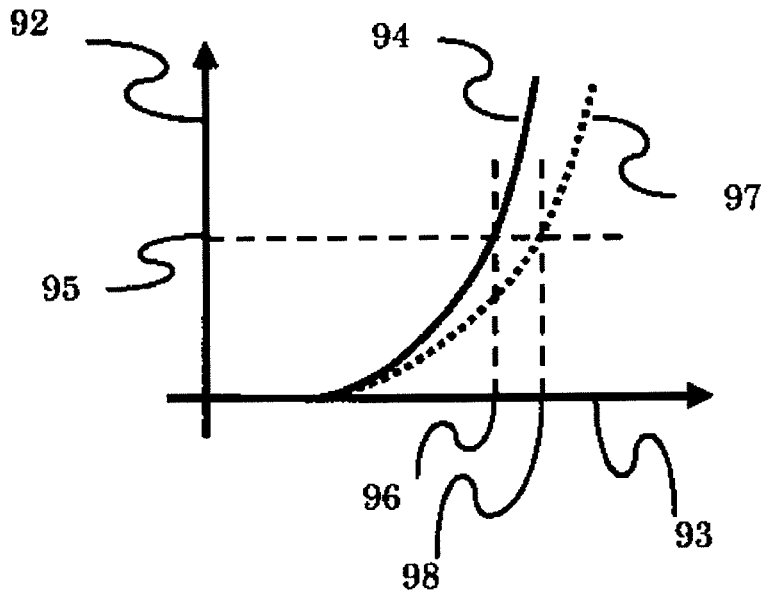
FIG. 6 is a graph showing one example of detected characteristic of an organic EL device shown in FIG. 3.

FIG. 6 is a diagram showing detected characteristic of the above described organic EL device 65. In FIG. 6, reference numeral 92 refers to a current axis, 93 refers to a voltage axis, 94 refers to current/voltage characteristic of an organic EL device, 95 refers to a constant current condition, and 96 refers to a voltage detected when a constant current is applied, or a constant current applied voltage. The current/voltage characteristic 94 presents a curved line representing the relationship between the current and voltage applied to the organic EL device 65. As the detection power source 73, or a constant current source, is connected in characteristic detection, the constant current applied voltage 96, or the voltage value on the curved line of the current/voltage characteristic 94 relative to the constant current condition 95 applied, will be the characteristic voltage to be detected.

Reference numeral 97 refers to current/voltage characteristic to be presented when the concerned organic EL device is deteriorated, and 98 refers to a constant current applied voltage when the concerned organic EL device is deteriorated. That is, the current/voltage voltage characteristic 94 is changed to the current/voltage characteristic 97 due to deterioration, in which the slope of the latter is smaller than that of the former. With the constant current condition 95 applied in the presence of deterioration, a constant current applied voltage 98 is detected. That is, an increased voltage due to deterioration, specifically, from the constant current applied voltage 96 to the constant current applied voltage 98, is detected.

Figure 7:
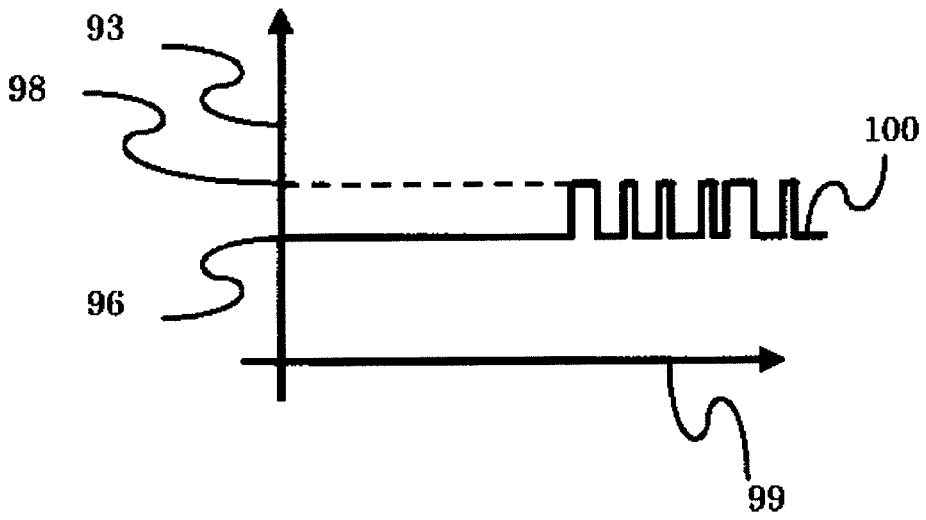
FIG. 7 is a diagram showing a constant current applied voltage of pixels in a single horizontal line shown in FIG. 5B.

FIG. 7 is a diagram showing a constant current applied voltage of the pixels aligned in the single horizontal line 91, shown in FIG. 5. In FIG. 7, reference numeral 99 refers to a horizontal display position, and 100 refers to a detected voltage. With the ordinates corresponding to the voltage axis 93, it is appreciated that the voltage 100 detected with respect to the pixels in the single horizontal line 91 includes the constant current applied voltage 96 for a pixel without burning and the constant current applied voltage 98 for a pixel with burning.

Figure 8:
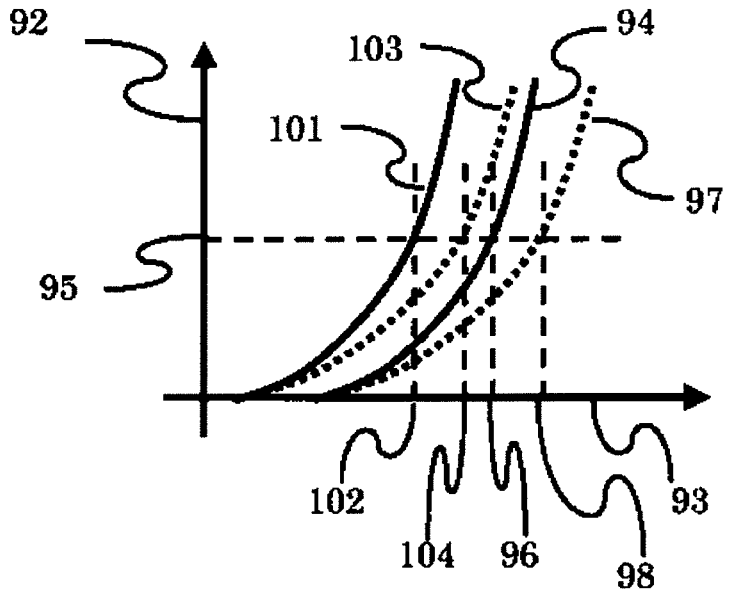
FIG. 8 is a diagram showing variation at high temperature of the detected characteristic of the organic EL device shown in FIG. 6.

FIG. 8 is a diagram showing variation at high temperature of the detected characteristic of the organic EL device 65. In FIG. 8, reference numeral 101 refers to current/voltage characteristic of the organic EL device 65 at high temperature, and 102 refers to a constant current applied voltage concerning the current/voltage characteristic 101. As the detection power source 73, or a constant current source, is connected in characteristic detection, as described above, the constant current applied voltage 102, or the voltage value on the curved line of the current/voltage characteristic 101 relative to the constant current condition 95 applied, will be the characteristic voltage to be detected at high temperature.

Reference numeral 103 refers to current/voltage characteristic with a deteriorated organic EL device 65 at high temperature, and 104 refers to a constant current applied voltage concerning the current/voltage characteristic 103. Similar to the above, the current/voltage voltage characteristic 101 is changed to the current/voltage characteristic 103 due to deterioration, in which the slope of the latter is smaller than that of the former. With the constant current condition 95 applied in the presence of deterioration, a constant current applied voltage 104 is detected. That is, an increased voltage due to deterioration, specifically from the constant current applied voltage 102 to the constant current applied voltage 104, is detected also at high temperature.

Figure 9:
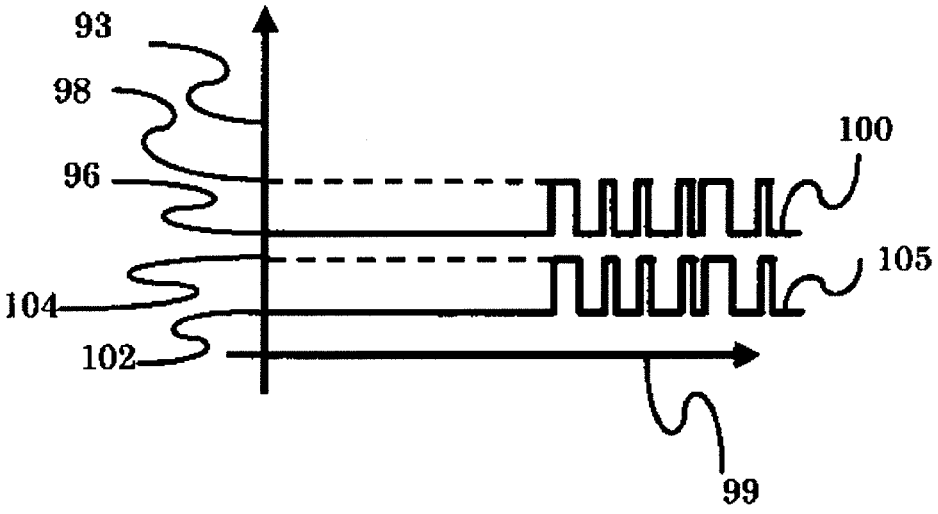
FIG. 9 is a diagram showing variation at high temperature of the constant current applied voltage of pixels in the single horizontal line shown in FIG. 7.

FIG. 9 is a diagram showing variation at high temperature of the constant current applied voltage of the pixels aligned in the single horizontal line 91, shown in FIG. 7. In FIG. 9, reference numeral 105 refers to a detected voltage at high temperature, and 100 refers to a detected voltage at normal temperature. It is appreciated that the entire level of the detected voltage 105 at high temperature is smaller than that of the detected voltage 100 at normal temperature.

Figure 10:
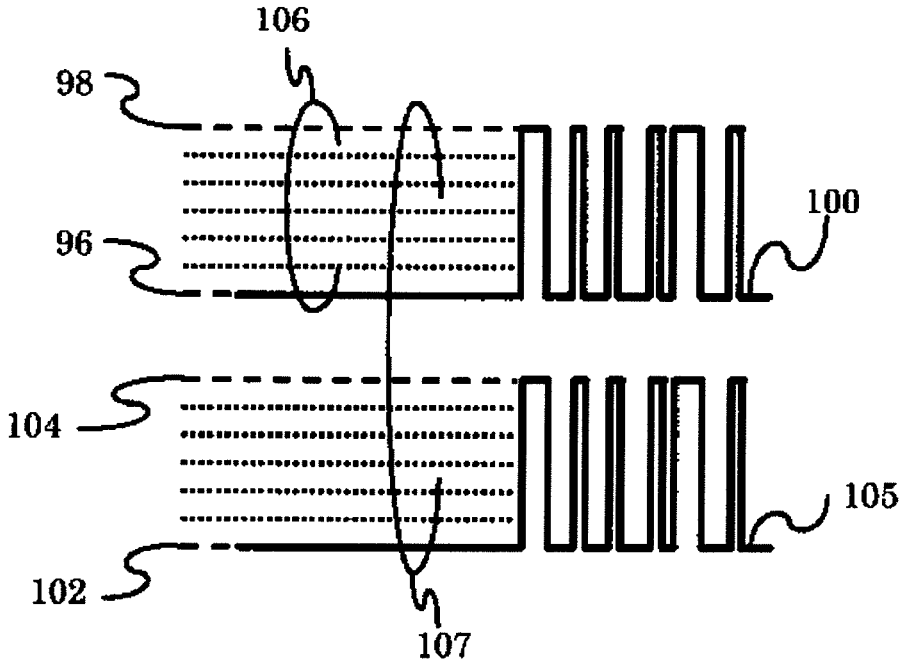
FIG. 10 is a diagram explaining one example of an A/D conversion reference voltage setting.

FIG. 10 is a diagram showing an example of reference voltage setting for A/D conversion so that a voltage can be detected at both of normal and high temperature. In FIG. 10, reference numeral 106 refers to a normal temperature voltage setting range, and 107 refers to a high temperature voltage setting range. For the normal temperature voltage setting range 106, the constant current applied voltage 98 in the presence of deterioration is defined as the maximum, and the constant current applied voltage 96 is defined as the minimum. In this example, seven levels are defined for burning detection levels, and A/D conversion is performed such that any voltage in an analog value between the maximum and minimum reference voltages is detected with a resolution of seven levels, and then converted into three-bit digital data before being output.

In the above, as the detected voltage 105 at high temperature is not included in the temperature voltage setting range 106, it is necessary to change the A/D conversion reference values so as to define the high temperature voltage setting range 107, which includes the normal temperature voltage setting range 106. In order to cover, as an A/D converter, the high temperature voltage setting range 107, provision of a plurality of A/D conversion units or an A/D converter covering a larger voltage setting range and increased resolution is required. These, however, inevitably increase the circuit size.

Figure 11:
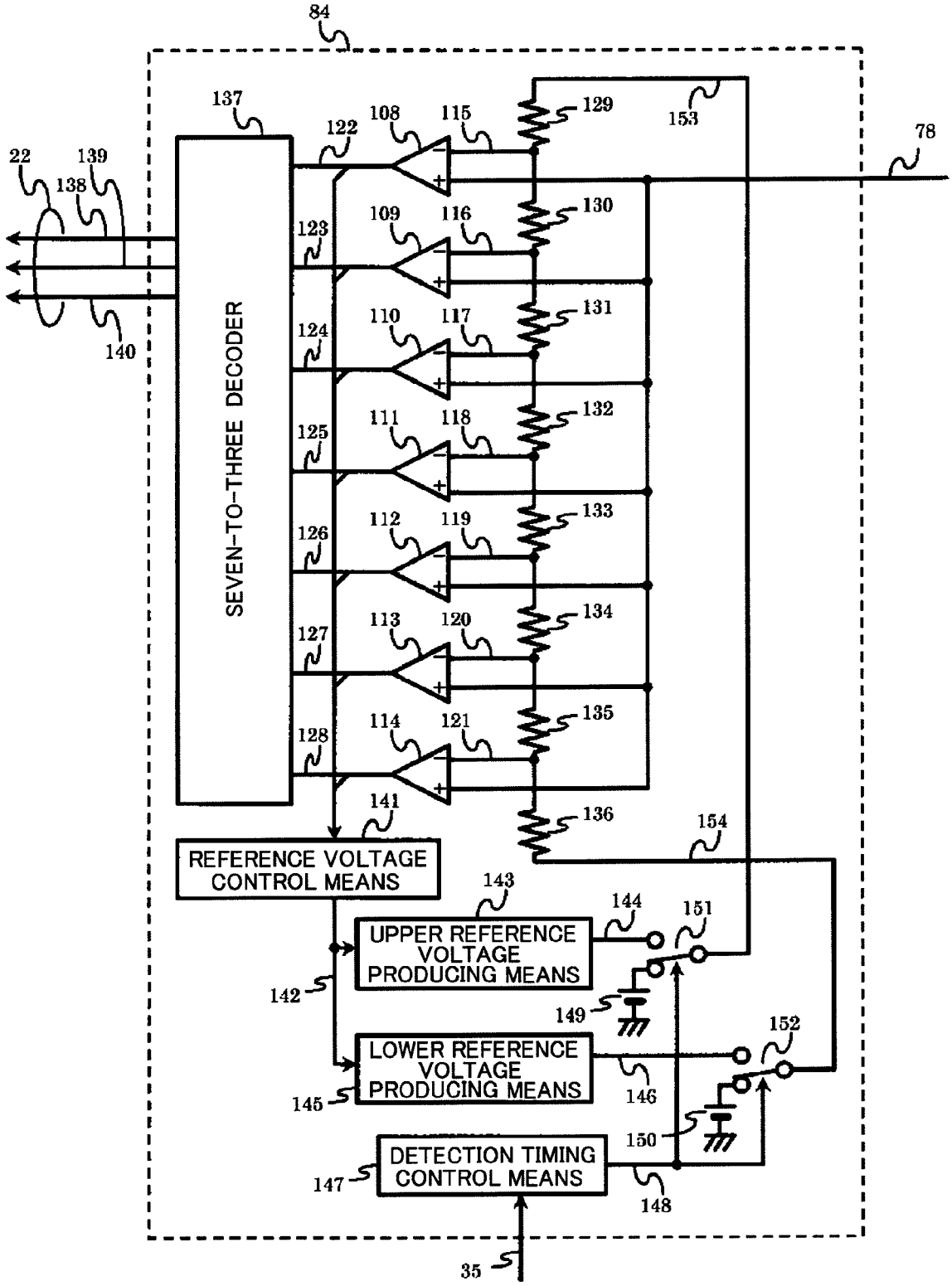
FIG. 11 is a diagram showing one embodiment of an interior structure of an A/D conversion means shown in FIG. 4.

FIG. 11 is a diagram showing one embodiment of an internal structure of the A/D conversion means 84, shown in FIG. 4. In FIG. 11, reference numeral 108 refers to a first comparator, 109 refers to a second comparator, 110 refers to a third comparator, 111 refers to a fourth comparator, 112 refers to a fifth comparator, 113 refers to a sixth comparator, 114 refers to a seventh comparator, 115 refers to a first comparison voltage, 116 refers to a second comparison voltage, 117 refers to a third comparison voltage, 118 refers to a fourth comparison voltage, 119 refers to a fifth comparison voltage, 120 refers to a sixth comparison voltage, 121 refers to a seventh comparison voltage, 122 refers to a first comparison result, 123 refers to a second comparison result, 124 refers to a third comparison result, 125 refers to a fourth comparison result, 126 refers to a fifth comparison result, 127 refers to a sixth comparison result, and 128 refers to a seventh comparison result. The respective comparators 108 to 114 compare the voltage of the detection output line 78 with the respective comparison voltages 115 to 121, and output the results as comparison results 122 to 128. For example, when the voltage of the detection output line 78 is larger than the comparison voltage, "1" is output as a comparison result.

Reference numeral 129 refers to a first partial voltage resistance, 130 refers to a second partial voltage resistance, 131 refers to a third partial voltage resistance, 132 refers to a fourth partial voltage resistance, 133 refers to a fifth partial voltage resistance, 134 refers to a sixth partial voltage resistance, 135 refers to a seventh partial voltage resistance, and an 136 refers to an eighth partial voltage resistance. The voltage between the upper reference voltage and lower reference voltage, to be described later, is divided through the respective partial voltage resistances 129 to 136, whereby comparison voltages 115 to 121 are produced.

Assuming that the first partial voltage resistance 129 and the eighth partial voltage resistance 136 are substantially 0 ohm, the first comparison voltage 115 is equal to the upper reference voltage, and the seventh comparison voltage 121 is equal to the lower reference voltage. Further, assuming that the second partial voltage resistance 130 to the seventh partial voltage resistance 135 all have equal resistance values, the second comparison voltage 116 to the sixth comparison voltage 120 are determined through equally dividing the voltage between the upper and lower reference voltages through these six resistances.

Reference numeral 137 refers to a seven-to-three decoder, 138 refers to a third digital bit output, 139 refers to a second digital bit output, and 140 refers to a first digital bit output. The seven-to-three decoder 137 decodes the comparison results 122 to 128, and outputs the results as three-bit digital outputs 138 to 140. Specifically, as the comparison results 122 to 128 are expressed in eight kinds of digital outputs, as described above, including "0000000", "0000001", "0000011", "0000111", "0001111", "0011111", "0111111", and "1111111", these are converted into "000", "001", "010", "011", "100", "101", "110", and "111", respectively.

Reference numeral 141 refers to a reference voltage control means, 142 refers to a burning detection reference voltage, 143 refers to an upper reference voltage producing means, 144 refers to a burning detection upper reference voltage, 145 refers to a lower reference voltage producing means, 146 refers to a burning detection lower reference voltage, 147 refers to a detection timing control means, 148 refers to a detection switching signal, 149 refers to a temperature detection upper reference voltage, 150 refers to a temperature detection lower reference voltage, 151 refers to an upper reference voltage switching means, 152 refers to a lower reference voltage switching means, 153 refers to an upper reference voltage, and 154 refers to a lower reference voltage. The detection timing control means 147 produces a detection switching signal 148 for switching time for temperature detection and burning detection. In response to the detection switching signal 148, the upper reference voltage switching means 151 and lower reference voltage switching means 152 output the temperature detection upper reference voltage 149 and temperature detection lower reference voltage 150, respectively, for temperature detection, and the burning detection upper reference voltage 144 and burning detection lower reference voltage 146, respectively, for burning detection as the upper reference voltage 153 and lower reference voltage 154, respectively. The reference voltage control means 141 produces the burning detection reference voltage 142 to be used as a reference for the upper and lower reference voltages for burning detection, based on the comparison results 122 to 128 obtained in temperature detection. The upper reference voltage producing means 143 and lower reference voltage producing means 145 produce the burning detection upper reference voltage 144 and burning detection lower reference voltage 146, respectively, using as a reference the burning detection reference voltage 142.

Figure 12A:
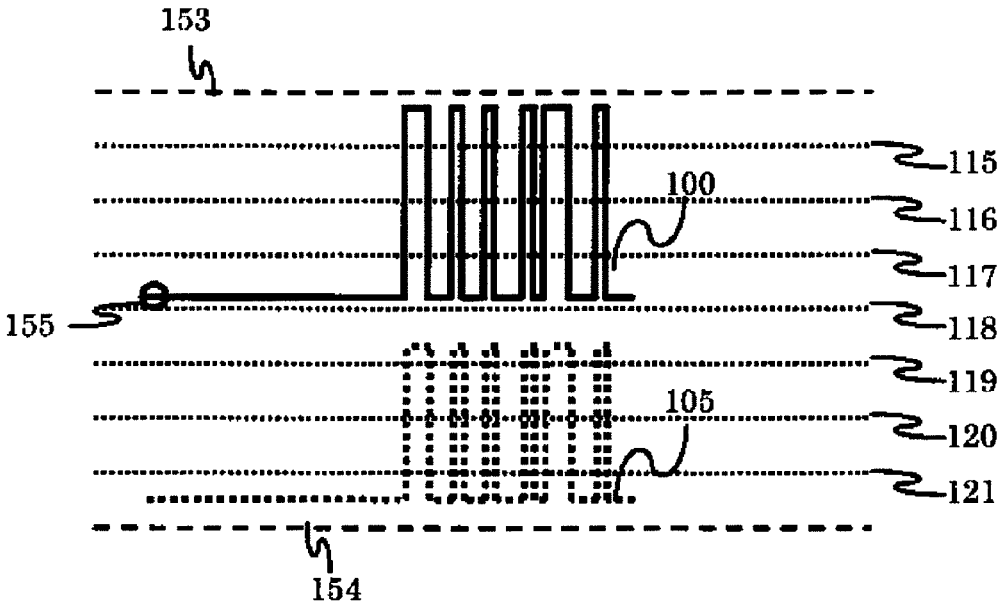
FIGS. 12A and 12B are diagrams explaining an operation of the A/D conversion means shown in FIG. 11.
Figure 12B:
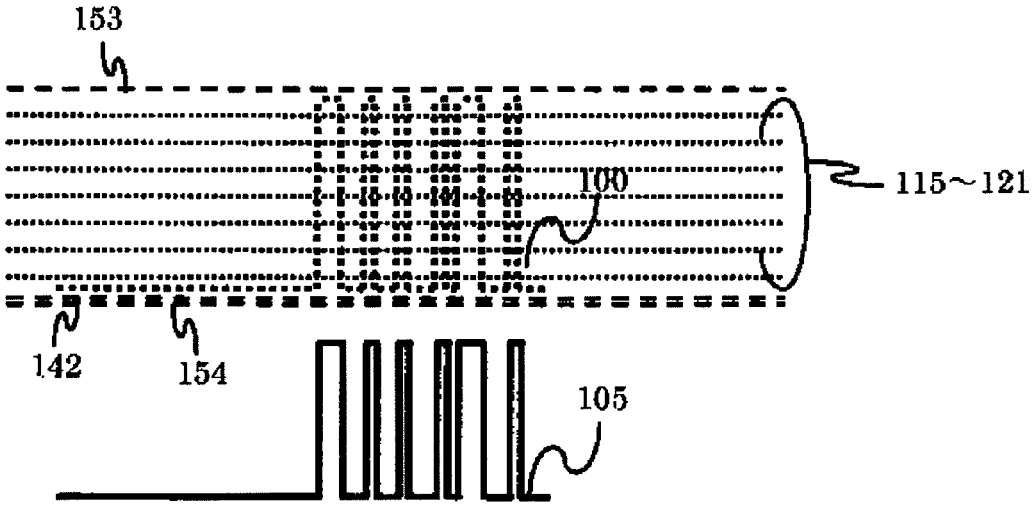

FIGS. 12A and 12B are diagrams explaining an operation of the A/D conversion means 84. FIG. 12A concerns a temperature detection operation, and FIG. 12B concerns a burning detection operation. Reference numeral 155 refers to a temperature detection point. In temperature detection, as the temperature detection upper reference voltage 149 is determined as the upper reference voltage 153 (see FIG. 11), and the temperature detection lower reference voltage 150 is determined as the lower reference voltage 154 (see FIG. 11), the comparison voltages 115 to 121 are determined as levels obtained through equally dividing the voltage between the temperature detection upper reference voltage 149 and the temperature detection lower reference voltage 150. Considering the range of temperature in circumstances where a concerned product is used, the highest voltage value at the lowest expected temperature is defined as the temperature detection upper reference voltage 149, and the lowest voltage value at the highest expected temperature is defined as the temperature detection lower reference voltage 150. In this embodiment, an operation for a case with higher ambient temperature will be described.

It is determined that the reference voltage range is substantially between the seventh comparison voltage 121 and the fourth comparison voltage 118, based on the result of temperature detection, and this result is reflected on the burning detection reference voltage 142. In this embodiment, a measured result at the temperature detection point 155 is determined as the burning detection reference voltage 142, the burning detection lower reference voltage 146 at the same level as the burning detection reference voltage 142 (see FIG. 11) is output as the lower reference voltage 154, and the burning detection upper reference voltage 144 (see FIG. 11) being a value obtained by adding the maximum width to be detected to the burning detection reference voltage 142 is determined as the upper reference voltage 153. With the above, finer comparison voltages 115 to 121 can be determined for burning detection, compared to those for temperature detection, so that much smaller change can be coped with.

Figure 13:
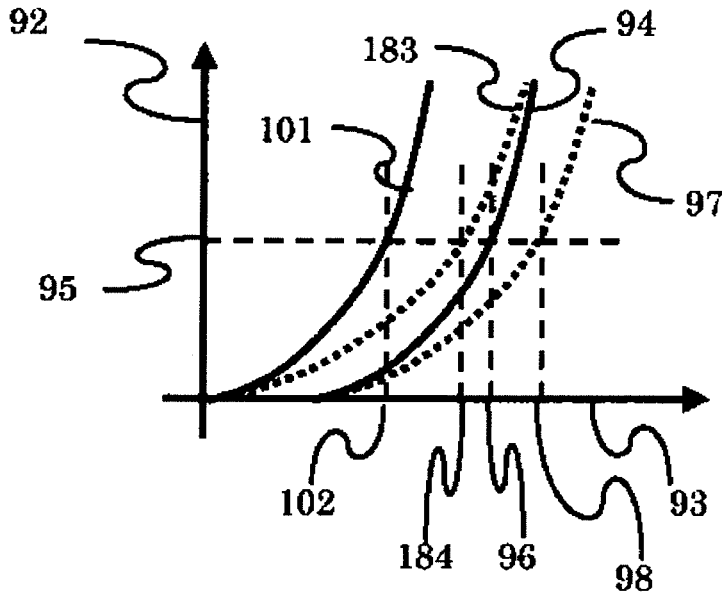
FIG. 13 is a diagram showing variation at high temperature of the detected characteristic of the organic EL device shown in FIG. 6, the variation presenting characteristic different from that shown in FIG. 8.

FIG. 13 is a diagram corresponding to FIG. 8, showing variation at high temperature of the detected characteristic of the organic EL device 65, the variation presenting characteristic different from that shown in FIG. 8. Similar to FIG. 8, reference numeral 101 refers to current/voltage characteristic of an organic EL device 65 at high temperature, 102 refers to a constant current applied voltage at high temperature, 183 refers to second current/voltage characteristic of an organic EL device 65 which is deteriorated at high temperature, and 184 refers to second constant current applied characteristic of an organic EL device 65 which is deteriorated at high temperature. That is, the current/voltage characteristic 101 is changed to the second current/voltage characteristic 183 due to deterioration, in which the slope of the latter is smaller, compared to that of the former. The extent of change due to deterioration is larger at high temperature than that at normal temperature. In other words, the second constant current applied voltage 184 is detected when the constant current condition 95 is applied. That is, the second constant current applied voltage 102 is changed to the second constant current applied voltage 184 due to deterioration at high temperature, and the extent of this change is larger, compared to the change at normal temperature from the constant current applied voltage 96 to the constant current applied voltage 98.

Figure 14:
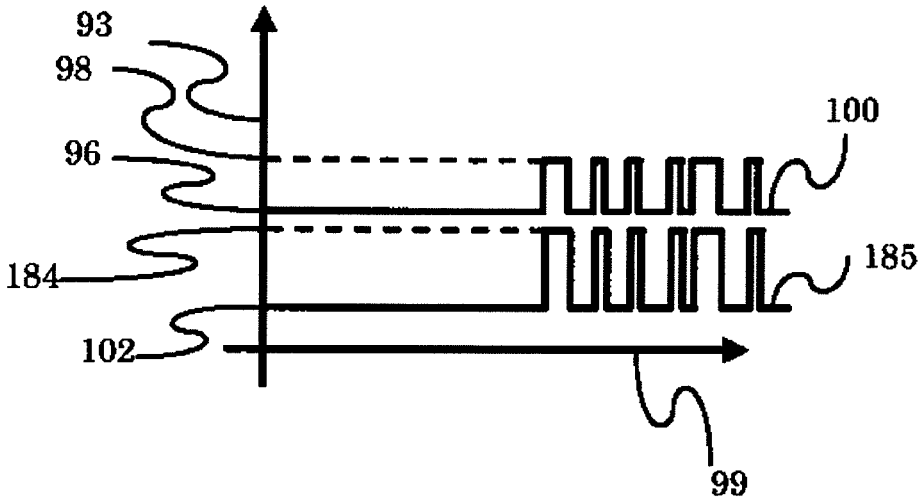
FIG. 14 is a diagram showing variation at high temperature of the constant current applied voltage of pixels in the single horizontal line shown in FIG. 7, the variation presenting characteristic different from that shown in FIG. 9.

FIG. 14 is a diagram corresponding to FIG. 9, showing variation at high temperature of the constant current applied voltage of the pixels aligned in the horizontal line 91, shown in FIG. 7, the variation presenting characteristic different from that shown in FIG. 9. In FIG. 14, reference numeral 185 refers to a high temperature second detected voltage, of which entire level is smaller, compared to that of the detected voltage 100 at normal temperature, and of which amplitude (the width of the current measurement range) is larger, compared to that of the high temperature detected voltage 105, shown in FIG. 9.

Figure 15:
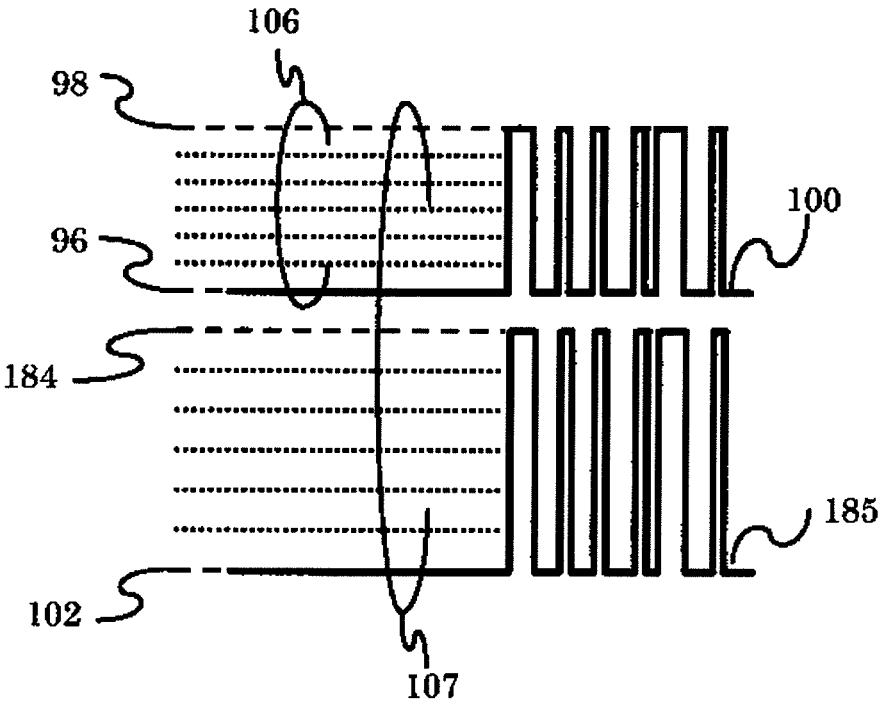
FIG. 15 is a diagram showing an A/D conversion reference voltage setting which presents characteristic different from that shown in FIG. 10.

FIG. 15 is a diagram corresponding to FIG. 10, showing an embodiment in which characteristic at high temperature of a reference voltage setting for A/D conversion is different from that shown in FIG. 10. In FIG. 15, similar to the case in FIG. 10, as the high temperature detected voltage 185 is not included in the normal temperature voltage setting range 106, it is necessary to change the A/D conversion reference voltage so as to define the high temperature voltage setting range 107. For this purpose, provision of a plurality of A/D converters or expansion of a voltage setting range and increase of resolution is necessary. This, however, increases the circuit size. Note that the range of the high temperature detected voltage 185 in FIG. 15 is remarkably larger than that in FIG. 10.

Figure 16A:
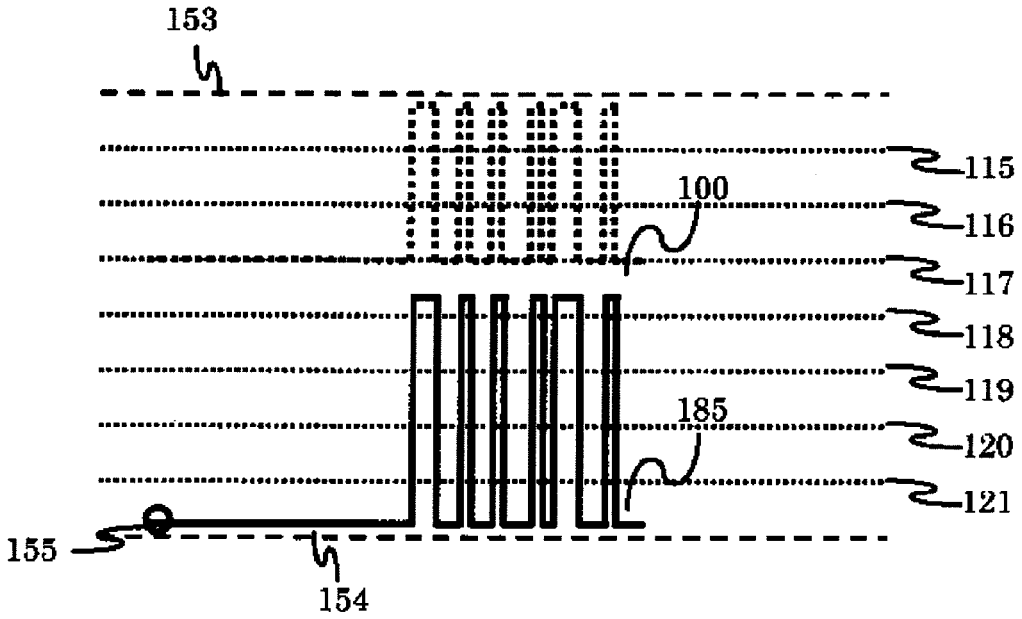
FIGS. 16A and 16B are diagrams showing variation at high temperature of an operation of the A/D conversion means shown in FIG. 11, the variation presenting characteristic different from that shown in FIG. 12.
Figure 16B:
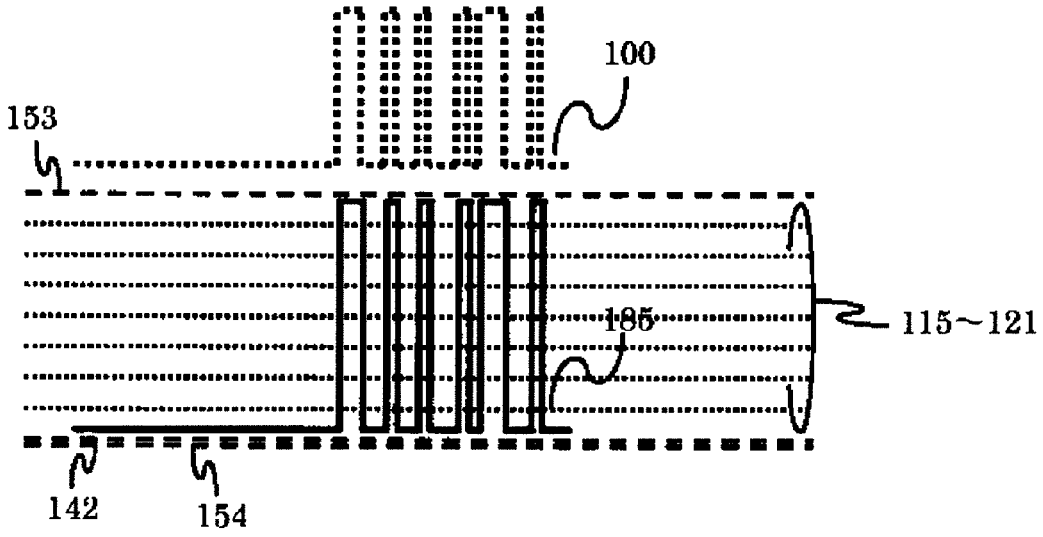

FIG. 16A and FIG. 16B are diagrams corresponding to FIG. 12A and FIG. 12B, showing an embodiment in which variation at high temperature of an operation of the A/D conversion means 84, shown in FIG. 11, presents characteristic different from that shown in FIG. 12A and FIG. 12B. In FIG. 16A and FIG. 16B, although the operation is similar to that in FIG. 12A and FIG. 12B, the range of the high temperature detected voltage 185 is larger, compared to that of the detected voltage 100 at normal temperature, and therefore, the comparison voltages 115 to 121 for burning detection are larger, compared to those at high temperature shown in FIG. 12A and FIG. 12B. Note that as the range of the high temperature detected voltage 185 can be calculated beforehand, based on the characteristic shown in FIG. 13, the comparison voltages 115 to 121 for burning detection are set, based on the calculated data.

In the following, burning detection which can cope with temperature variation will be described, referring to FIG. 1 to FIG. 16. Initially, referring to FIG. 1, a flow of display data in the image display device will be described. In FIG. 1, the display and detection control unit 6 produces the data line control signal 7 and scanning line control signal 8 for indicating a time for displaying on the light emitting device display 17, based on the vertical synchronous signal 1, the horizontal synchronous signal 2, the data enable 3, and the synchronous clock 5. In addition, the detection scanning line control signal 9 and detection line control signal 10 for indicating a time for detecting the state of a pixel of the light emitting device display 17 are produced, with details thereof to be described later.

The data line driving means 11, the scanning line driving means 15, and the light emission voltage producing means 13 operate similarly to a conventional case. The device characteristic detection scanning means 18 produces the detection scanning line selection signal 19, based on the detection scanning line control signal 9 in order to scan a pixel of detection target during a detection period which is provided separately from a display operation period. The burning detection and position determination means 21 detects the state of deterioration of a device, based on the state of the detection line output signal 20, which indicates the characteristics of a pixel in a scanning line selected in response to the detection scanning line selection signal 19, and determines the position of that pixel, based on the detection line control signal 10. With the above, the position information 23, or address information to be stored in the burning information storage means 24, and the burning detection result 22 indicating the level of deterioration of the device are produced, with details thereof to be described later. Note that the burning correction pixel information 25 is information about the level of deterioration of a device, read from the burning information storage means 24 according to a display timing of the device.

In the following, referring to FIG. 2, details of an operation of the display and detection control unit 6 will be described. In FIG. 2, the burnt pixel data correction means 26 corrects only deteriorated pixel data among the display data 4, based on the burning compensation amount 38, and outputs data of other pixels uncorrected as corrected display data 27, with details thereof to be described later. The driving timing producing means 28 produces the horizontal start signal 29, the horizontal shift clock 30, the vertical start signal 31, and the vertical shift clock 32 similarly to a conventional case. The driving timing producing means 28 produces the vertical detection start signal 33 and the vertical detection shift clock 34, or timing signals for scanning a detection scanning line during a detection period provided separately from a display period in one display period. The driving timing producing means 28 also produces the horizontal detection start signal 35 and horizontal detection shift clock 36, or timing signals for horizontally and sequentially outputting the state of a pixel in the detection scanning line selected.

In the following, in FIG. 3, in response to the scanning line selection signals sequentially output via the first detection scanning line 67 and the second detection scanning line 68, the organic EL devices 65 of the respective pixels are connected via the detection switches of the respective pixels to the first detection line 69, the second detection line 70, the third detection line 71, the fourth detection line 72, and up to the $320^{th}$ detection line (not shown), respectively, so that respective characteristics are output as detection line output signals 20.

In FIG. 4, in temperature characteristic detection, only a characteristic of a pixel selected by a detection line selection signal and a detection line switch corresponding to a temperature detection point, to be described later, are output to the detection output line 78. Meanwhile, in burning detection, the first detection line switch 74, the second detection line switch 75, the third detection line switch 76, and the fourth detection line switch 77 are horizontally and sequentially selected and turned on in response to the first detection line selection signal 80, the second detection line selection signal 81, the third detection line selection signal 82, and the fourth detection line selection signal 83, respectively, these signals being produced in the shift register 79 in response to the detection horizontal start signal 35 and the detection horizontal shift clock 36. During a period with a respective switch remaining in the ON state, a signal from the concerned detection line is output to the detection output line 78, as described above.

In the above, as the organic EL device 65 shown in FIG. 3 is connected to the detection power source 73, or a constant current source (see FIG. 4), the organic EL device 65 having the characteristic shown in FIG. 8 outputs the constant current applied voltage 96 at normal temperature and the high temperature constant current applied voltage 102 at high temperature when the white representation 89, shown in FIG. 5B, is shown, and the deteriorated device constant current applied voltage 98 at normal temperature and the high temperature deteriorated device constant current applied voltage 104 at high temperature when the burned pattern 90 is shown as detected characteristic to the detection output line 78. As a result, the device characteristic such as is shown in FIG. 9 is detected with respect to the devices in the single horizontal line 91, shown in FIG. 5B.

In the A/D conversion means 84, considering a larger temperature range, the maximum and minimum of a larger voltage range are initially set as A/D conversion reference voltages. Thereafter, temperature detection is carried out to detect a voltage, and the maximum and minimum of the detected voltage are newly set as the A/D conversion reference voltages. In the subsequent burning detection, the A/D conversion means 84 converts analog data from the detection output line 78 into digital data, based on the reference voltages newly set, and outputs as the detection result 22. In the above, the burnt pixel position information producing means 85 determines the position of the pixel subjected to burning detection, based on the vertical detection start signal 33, the horizontal detection start signal 35, and the horizontal detection shift clock 36, and outputs information about the position as the position information 23.

When the organic EL device 65 is connected to the detection power source 73, or a constant current source, the characteristic of the organic EL device 65 will change over temperature, as shown in FIG. 8. As shown in FIG. 9, the organic EL device 65 outputs the constant current applied voltage 96 or the deteriorated device constant current applied voltage 98 at normal temperature as detected characteristic to the detection line output signal 20. Similarly, the organic EL device 65 outputs the high temperature constant current applied voltage 102 or the high temperature deteriorated device constant current applied voltage 104 at high temperature As a result, the characteristic of the devices aligned in the signal horizontal line 91, shown in FIG. 5, changes largely, as shown in FIG. 9.

The A/D conversion means 84 carries out digital conversion, referring to the seven levels within the voltage setting range. As shown in FIG. 10, at normal temperature, for example, the normal temperature voltage setting range 106 is a voltage setting range necessary for the A/D conversion means to carry out digital conversion to the detected voltage 100 (analog value). Meanwhile, at increased temperature due to high ambient temperature or a long lighting time, a voltage, indicated by the high temperature detected voltage 105, which is largely shifted from the detected voltage 100 at normal temperature, is detected. In this case, digital conversion cannot be carried out within the normal temperature voltage setting range 106. Therefore, in order to cope with the situation, using the same A/D conversion means, it is necessary to expand the voltage setting range to, e.g., the high temperature voltage setting range 107 and to increase the number of levels for conversion or to provide a plurality of A/D conversion means. Any of these, however, increase the circuit size.

In view of the above, in this embodiment, the above described situation is addressed by setting variable reference voltage of the A/D conversion means 84, as shown in FIG. 11. That is, the detection timing control means 147 carries out timing control such that temperature characteristic detection is always carried out before burning detection. In temperature characteristic detection, device characteristic at the temperature detection point 155 is detected, in which comparison voltages 115 to 121 are produced, using as a reference the temperature detection upper reference voltage 149 and temperature detection lower reference voltage 150. In the above, the temperature detection upper reference voltage 149 and temperature detection lower reference voltage 150 are set so as to define the maximum possible range for the characteristic of the organic EL device 65 under any temperature circumstances in which a concerned product is used. As a result, a wide voltage setting range with rough interval for comparison voltages is set, as shown in FIG. 12A.

As shown in FIG. 16A and FIG. 16B, as the A/D conversion result at the temperature detection point 155 is substantially close to the seventh comparison voltage 121 in this embodiment, this result is reflected on the burning detection reference voltage 142. Specifically, the detection lower reference voltage 146 is set at a voltage same as the burning detection reference voltage 142, and output as the lower reference voltage 154. Then, a voltage obtained by adding the maximum width of change of a voltage to be detected at the temperature at which the burning detection reference voltage 142 is detected to the burning detection reference voltage 142 is set as the burning detection upper reference voltage 144, and output as the upper reference voltage 153. With the upper reference voltage 153 and lower reference voltage 154 determined as described above, smaller voltage intervals for the comparison voltages 115 to 121 are determined for burning detection, compared to those for temperature detection. This enables detection of smaller voltage change. Note that although the A/D conversion result at the temperature detection point 155 is used as the lower reference voltage in this embodiment, the upper and lower reference voltages may be produced through addition and subtraction, respectively, using the A/D conversion result in the middle of the range. Alternatively, a lower reference voltage may be produced through subtraction, using the A/D conversion result as the upper reference voltage.

In the following, a deteriorated device detection operation for a case in which deterioration characteristic at normal temperature differs from that at high temperature, as shown in FIG. 13 to FIG. 16B, will be described.

When connected to the detection power source 73, or a constant current source, shown in FIG. 4, the organic EL device 65, of which characteristic changes over temperature, outputs the constant current applied voltage 96 or the deteriorated device constant current applied voltage 98 at normal temperature, and the high temperature constant current applied voltage 102 or the high temperature deteriorated device constant current applied voltage 184 at high temperature as detected characteristic to the detection line output signal 20, as shown in FIG. 9. As a result, the detected characteristic of the devices in the single horizontal line 91, shown in FIG. 5B, changes largely, as shown in FIG. 9. Comparison with a case in which deterioration characteristic is identical between normal temperature and high temperature shows that the amplitude of the detected result (the width of a current measurement range) is different from that in the case.

In the following, as shown in FIG. 15, the A/D conversion means 84 carries out digital conversion, referring to the seven levels within the voltage setting range. At normal temperature, for example, a voltage setting range necessary for the A/D conversion means 84 to carry out digital conversion to the detected voltage 100 expressed as analog data is set as the normal temperature voltage setting range 106. Meanwhile, at increased temperature of the panel due to high ambient temperature or a long lighting time, the level of the high temperature detected voltage 185 changes largely, compared to the detected voltage 100, and the amplitude (the width of the current measurement range) thereof is different from that in the case in which deterioration characteristic is identical between normal temperature and high temperature.

Such large level change and amplitude change are addressed by setting variable reference voltage of the A/D conversion means 84 (see FIG. 11). While the operation is substantially identical to that in the case in which deterioration characteristic is identical between normal temperature and high temperature, the upper reference voltage 153 and lower reference voltage 154 are produced such that the larger comparison voltages 115 to 121 are set for burning detection at high temperature, compared to those at normal temperature. Note that, as the width between the comparison voltages 115 and 121, shown in FIG. 16B, can be determined, based on the characteristic diagram shown in FIG. 13, the upper reference voltage 153 and lower reference voltage 154 can be determined, based on the width.

With the above described operation, referring to FIG. 1, the burning and position determination means 21 outputs the result of detection of burning phenomenon due to a deteriorated device in the light emitting device display 17 as the burning detection result 22 indicating the level of burning and the position information 23 indicating the position of the concerned pixel. The burning detection result 22 is stored at an address according to the position information 23 in the burning information storage means 24, burning information of the concerned pixel is read from the burning information storage means 24 according to a display timing, and the display data is corrected upon necessity. With the above, burning phenomenon is solved.

Second Embodiment

In the following, a second embodiment of the present invention will be described in detail, referring to the accompanying drawings.

Figure 17:
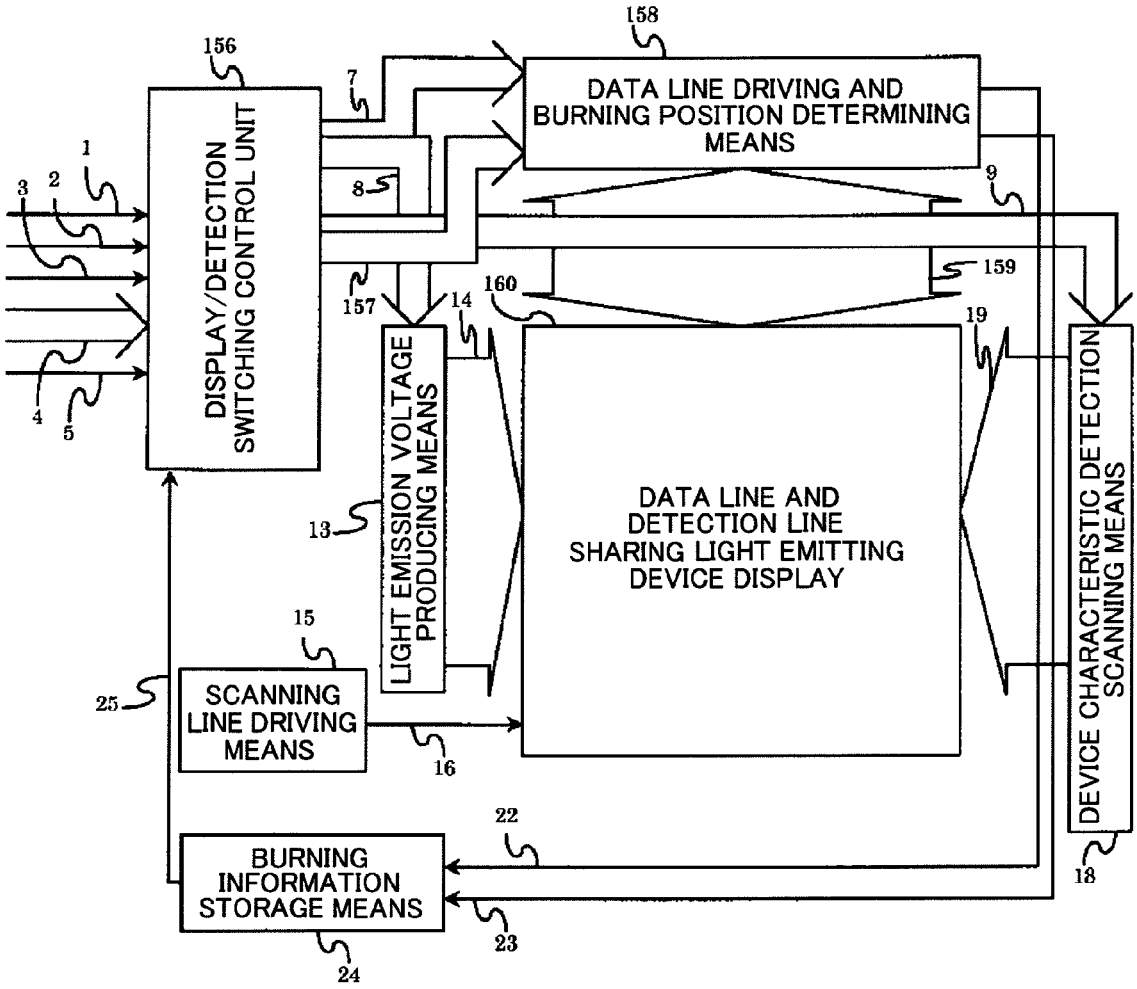
FIG. 17 is a diagram showing another embodiment of the image display device according to the present invention.

FIG. 17 shows a light emitting device display device according to a second embodiment of the present invention. In FIG. 17, a member given a reference numeral identical to that in FIG. 1 has a structure identical to that in the first embodiment, and operates identically. Reference numeral 156 refers to a display/detection switching control unit, 157 refers to a display/detection switching control signal, 158 refers to a data line driving and black point defect position determination means, 159 refers to a data line driving and detection line output signal, and 160 refers to a data line and detection line sharing light emitting device display. The display/detection switching control unit 156 produces a data line control signal 7, a scanning line control signal 8, and a detection scanning line control signal 9, and also produces a display/detection switching control signal 157, or a signal obtained by adding a signal for switching data line driving and an detection operation to the detection line control signal. The data line driving and burning position determining means 158 has the functions of the data line driving means and the burning detection and position determination means in the first embodiment, and connects the data line driving and detection line output signal 159 to the data line and detection line sharing light emitting device display 160 via a common data line.

Figure 18:
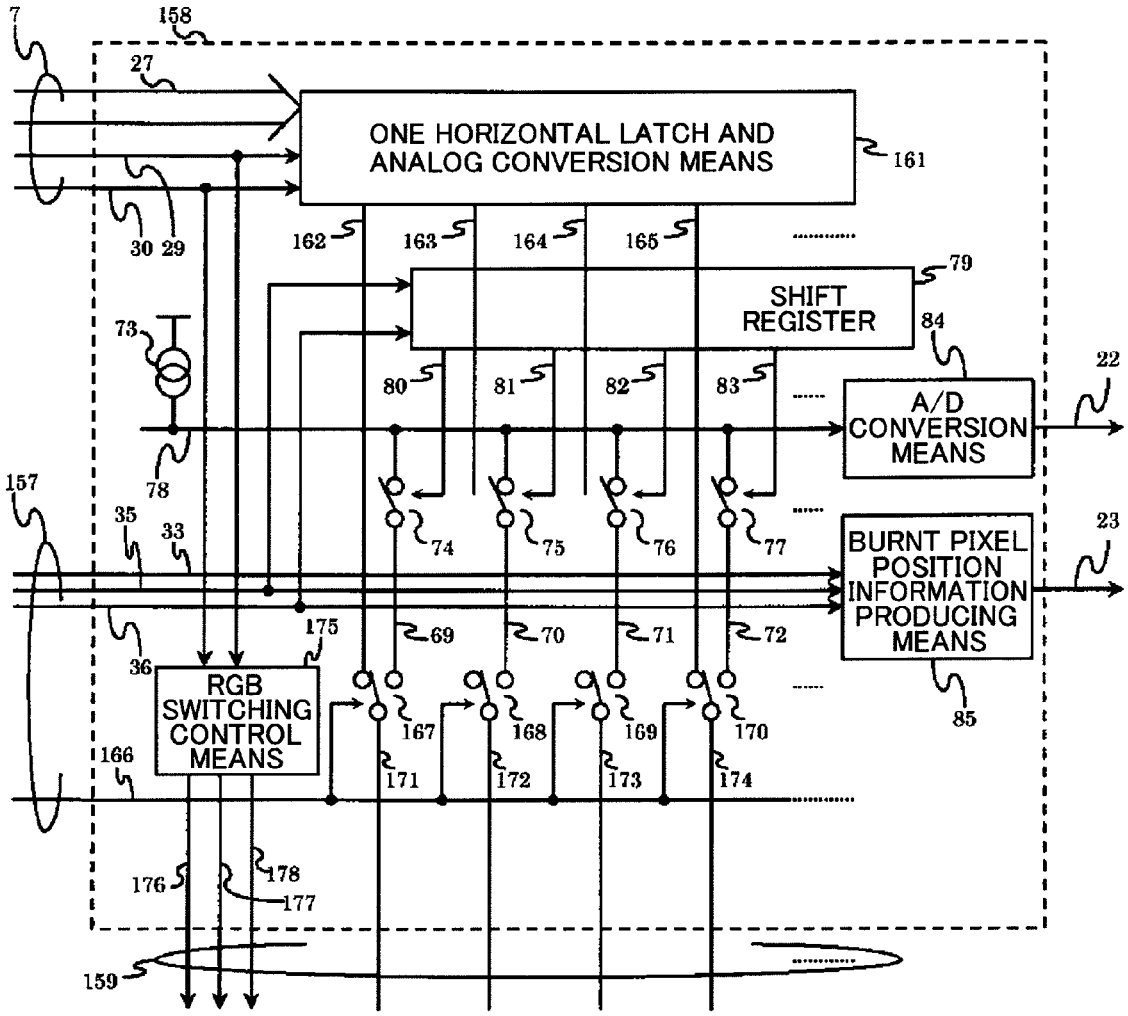
FIG. 18 is a diagram showing one embodiment of an internal structure of a data line driving and burning position determining means shown in FIG. 17.

FIG. 18 is a diagram showing one embodiment of an internal structure of the data line driving and burning position determining means 158. In FIG. 18, a member given a reference numeral identical to that in FIG. 4 is identical to that in the first embodiment, and operates identically. Reference numeral 161 refers to a one horizontal latch and analog conversion means, 162 refers to a first data line driving signal output, 163 refers to a second data line driving signal output, 164 refers to a third data line driving signal output, and 165 refers to a fourth data line driving signal output. Similar to the first embodiment, the one horizontal latch and analog conversion means 161 takes in the corrected display data 27 in response to the horizontal start signal 29 and the horizontal shift clock 30. The pixel data for one horizontal line, obtained as described above, is output to the first data line driving signal output 162, the second data line driving signal output 163, the third data line driving signal output 164, the fourth data line driving signal output 165, and up to the $240^{th}$ data line driving signal output.

Reference numeral 166 refers to a detection switching signal, 167 refers to a first data line detection switch, 168 refers to a second data line detection switch, 169 refers to a third data line detection switch, 170 refers to a fourth data line detection switch, 171 refers to a first data line and detection line, 172 refers to a second data line and detection line, 173 refers to a third data line and detection line, and 174 refers to a fourth data line and detection line. In this embodiment, 240 detection lines are provided as the data line and detection line share a common line, different from the first embodiment.

In display driving, the first data line detection switch 167, the second data line detection switch 168, the third data line detection switch 169, the fourth data line detection switch 170, and up to the $240^{th}$ data line detection switch output the first data line driving signal output 162, the second data line driving signal output 163, the third data line driving signal output 164, the fourth data line driving signal output 165, and up to the $240^{th}$ data line driving signal output, respectively, to the first data line and detection line 171, the second data line and detection line 172, the third data line and detection line 173, the fourth data line and detection line 174, and up to the $240^{th}$ data line and detection line, respectively, in response to the detection switching signal 166, so that a display operation identical to that in the first embodiment is carried out.

In detection, the first detection line 69, the second detection line 70, the third detection line 71, the fourth detection line 72, and up to the $240^{th}$ detection line are connected to the first data line and detection line 171, the second data line and detection line 172, the third data line and detection line 173, the fourth data line and detection line 174, and up to the $240^{th}$ data line and detection line, respectively, so that a detection operation identical to that in the first embodiment is carried out for each of R, G, and B within one horizontal period.

Reference numeral 175 refers to an RGB switching control means, 176 refers to an R display detection selection signal, 177 refers to a G display detection selection signal, and 178 refers to a B display detection selection signal. Similar to the first embodiment, in order to carry out detection, as well as RGB data line signal writing, for each of R, G, and B during one horizontal period, the RGB witching control means 175 produces an R display and detection selection signal 176, a G display and detection selection signal 177, and a B display and detection selection signal 178, as switching signals for dividing one horizontal period into three portions.

Figure 19:
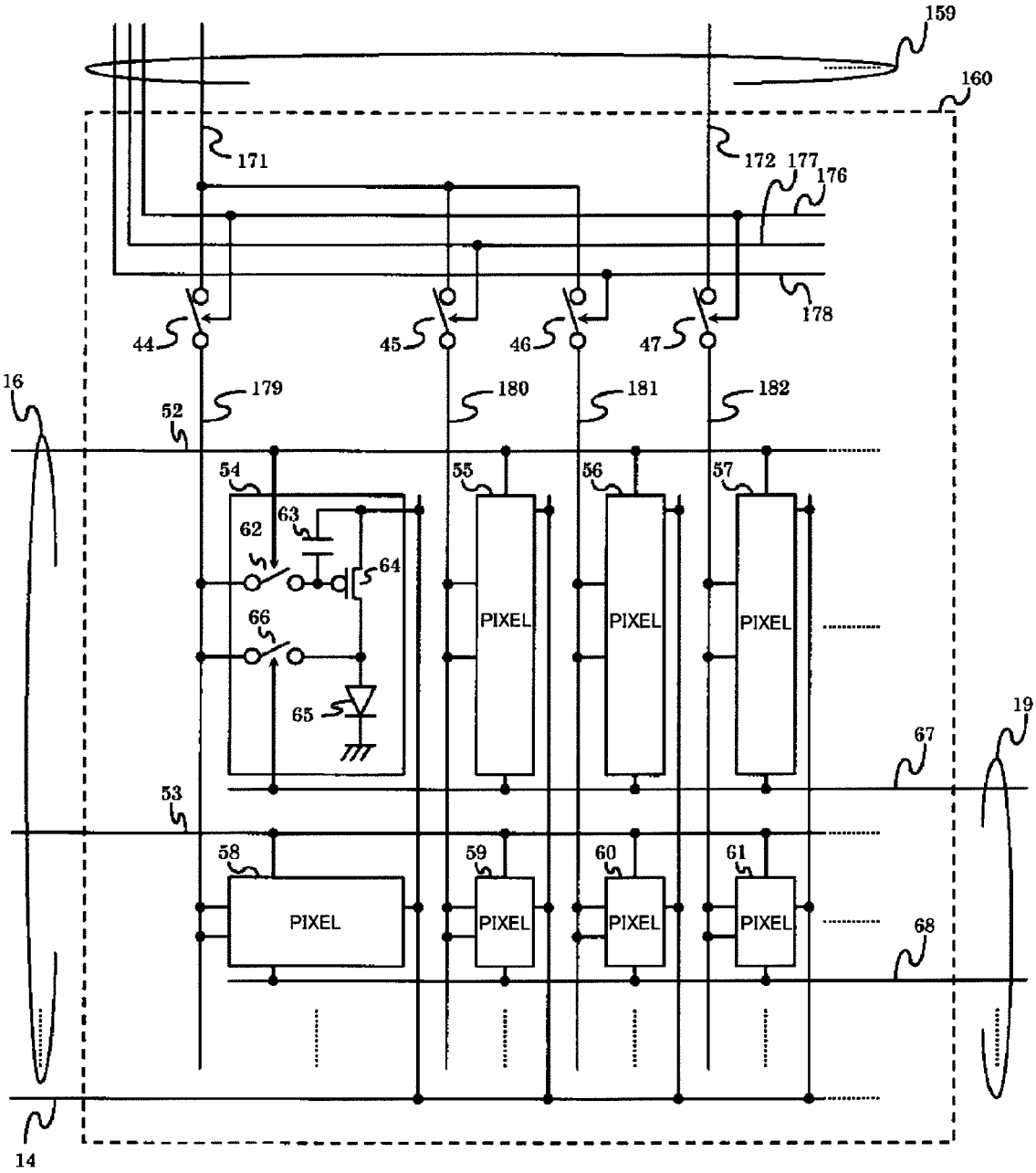
FIG. 19 is a diagram showing one embodiment of an internal structure of a data line and detection line sharing light emitting device display shown in FIG. 17.

FIG. 19 is a diagram showing one embodiment of an internal structure of the data line and detection line sharing light emitting device display 160. In FIG. 19, a member given an identical reference numeral to that in FIG. 3 is identical to that in the first embodiment, and operates identically. Reference numeral 179 refers to a first R display detection common line, 180 refers to a first G display detection common line, 181 refers to a first B display detection common line, and 182 refers to a second R display detection common line. For example, 720 display detection common lines in total are provided, including 240 G display detection common lines, 240 G display detection common lines, and 240 B display detection common lines.

In display driving, the data writing switches 62 in the respective pixels are turned on, to thereby connect the first R display detection common line 179, the first G display detection common line 180, the first B display detection common line 181, the second R display detection common line 182, and up to the $240^{th}$ R display detection common line, the $240^{th}$ G display detection common line, the $240^{th}$ B display detection common line to the writing capacitance 63, so that a signal voltage writing operation identical to that in the first embodiment is carried out. In detection, the detection switches 66 in the respective pixels are turned on, to thereby connect the above described respective lines to the respective organic EL devices 65, so that a characteristic detection operation identical to that in the first embodiment is carried out.

In this embodiment, operations other than switching to share a common line as a data line and a detection line are identical to those in the first embodiment.

The present invention has been described in the above, referring to embodiments. Note that the structures described in the respective embodiments are merely for illustration, and the present invention can be modified within a range not departing from the technical concept of the present invention. Also, the structures described in the respective embodiments may be used combined as long as no discrepancy is caused.

What is claimed is:

1. An image display device having a display unit comprising a plurality of display elements, a signal line configured to input a display signal voltage to the display unit, and a display control unit configured to control the display signal voltage, the image display device comprising:

a detection power source;

a switch configured to cause current from the detection power source to flow to the display elements of the plurality of display elements;

a detection circuit configured to detect a characteristic of each display elements of the plurality of display elements if the current is flowing to the display elements of the plurality of display elements; and a detection information storage circuit configured to store information detected by the detection circuit, the information being usable to compensate the display signal voltage;

wherein the detection circuit comprises an A/D converter, the A/D converter being configured to the characteristic of the display element from an analog value to a digital value, and wherein the detection circuit is configured to detect the characteristic of each display element of the plurality of display elements by:

performing a first detection operation of detecting the characteristic of each display element included in a first group of display elements of the plurality of display elements sequentially, the first detection operation being performed using a first reference voltage range between a first upper reference voltage and a first lower reference voltage applied to the A/D converter;

determining a second upper reference voltage based on a maximum characteristic value of the characteristics among the characteristics detected of the display elements of the first group of display elements;

determining a second lower reference voltage based on a minimum characteristic value of the characteristics among the characteristics detected of the display elements of the first group of display elements;

performing a second detection operation of detecting the characteristic of each display element of the first group of display elements, the second detection operation being performed under a common temperature condition with the first detection operation, the second detection operation being performed using a second reference voltage range between the second upper reference voltage and the second lower reference voltage applied to the A/D converter, the second reference voltage range being different from the first reference voltage range; and outputting the characteristic of each display element of the first group of display elements detected during the second detection operation to the detection information storage circuit to be stored as the information detected by the detection circuit and used for compensating the display signal voltage.

2. The image display device according to claim 1, wherein the switch is configured to connect the detection power source and at least one display element of the plurality of display elements during a period within one display period, the period being different from a period during which the display signal voltage is output.

3. The image display device according to claim 1, wherein the detection power source is a constant current source, and the characteristic of each display element of the plurality of display elements is a voltage across a respective display element.

4. The image display device according to claim 1, wherein the detection circuit is configured to determine a level of a deteriorated display element of the plurality of display elements, and the detection information storage circuit is configured to store a state of the deteriorated display element of the plurality of display element for one screen image based on the determined level.

5. The image display device according to claim 4, wherein the display control circuit is configured to correct display data to be input to the deteriorated display element of the plurality of display elements.

6. The image display device according to claim 1, further comprising a switch configured to cause, in a time sharing manner, respective signals for red, green, and blue to be input to the display unit while the display signal voltage is input.

7. The image display device according to claim 1, wherein the first detection operation is a temperature detection operation and wherein the second detection operation is a burning detection operation based on results obtained from the temperature detection operation.

8. An image display device having a display unit comprising a plurality of display elements, a data signal line configured to input a display signal voltage to the display unit, and a display control unit configured to control the display signal voltage, the image display device comprising:

a detection power source;

a switch configured to cause current from the detection power source to flow via a detection signal line to the display elements of the plurality of display elements;

a detection circuit configured to detect a characteristic of each display elements of the plurality of display elements if the current is flowing to the display elements of the plurality of display elements; and a detection information storage circuit configured to store information detected by the detection circuit, the information being usable to compensate the display signal voltage;

wherein the data signal line and the detection signal line comprise a common signal line to be switched by a switching circuit, wherein the detection circuit comprises an A/D converter, the A/D converter being configured to the characteristic of the display element from an analog value to a digital value, and wherein the detection circuit is configured to detect the characteristic of each display element of the plurality of display elements by:

performing a first detection operation of detecting the characteristic of each display element included in a first group of display elements of the plurality of display elements sequentially, the first detection operation being performed using a first reference voltage range between a first upper reference voltage and a first lower reference voltage applied to the A/D converter;

determining a second upper reference voltage based on a maximum characteristic value of the characteristics among the characteristics detected of the display elements of the first group of display elements;

determining a second lower reference voltage based on a minimum characteristic value of the characteristics among the characteristics detected of the display elements of the first group of display elements;

performing a second detection operation of detecting the characteristic of each display element of the first group of display elements, the second detection operation being performed under a common temperature condition with the first detection operation, the second detection operation being performed using a second reference voltage range between the second upper reference voltage and the second lower reference voltage applied to the A/D converter, the second reference voltage range being different from the first reference voltage range; and outputting the characteristic of each display element of the first group of display elements detected during the second detection operation to the detection information storage circuit to be stored as the information detected by the detection circuit and used for compensating the display signal voltage.

9. The image display device according to claim 8, wherein the switch is configured to connect the detection power source and at least one display element of the plurality of display elements during a period within one display period, the period being different from a period during which the display signal voltage is output.

10. The image display device according to claim 8, wherein the detection power source is a constant current source, and the characteristic of each display element of the plurality of display elements is a voltage across a respective display element.

11. The image display device according to claim 8, wherein the detection circuit is configured to determine a level of a deteriorated display element of the plurality of display elements, and the detection information storage circuit is configured to store a state of the deteriorated display element of the plurality of display element for one screen image based on the determined level.

12. The image display device according to claim 11, wherein the display control circuit is configured to correct display data to be input to the deteriorated display element of the plurality of display elements.

13. The image display device according to claim 8, further comprising a switch configured to cause, in a time sharing manner, respective signals for red, green, and blue to be input to the display unit while the display signal voltage is input.

14. The image display device according to claim 8, wherein the first detection operation is a temperature detection operation and wherein the second detection operation is a burning detection operation based on results obtained from the temperature detection operation.

* * * * *